US012742455B2

(12) United States Patent
Lee et al.

(10) Patent No.: US 12,742,455 B2
(45) Date of Patent: Sep. 22, 2026

(54) COMPRESSOR

(71) Applicant: SAMSUNG ELECTRONICS CO., LTD., Suwon-si (KR)

(72) Inventors: Sedong Lee, Suwon-si (KR); Joonhyung Kim, Suwon-si (KR); Munseong Kwon, Suwon-si (KR); Jaewoo Park, Suwon-si (KR); Wooju Jeon, Suwon-si (KR); Jongwon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 19/213,392

(22) Filed: May 20, 2025

(65) Prior Publication Data

US 2026/0009384 A1 Jan. 8, 2026

Related U.S. Application Data

(63) Continuation of application No. PCT/KR2025/005952, filed on May 2, 2025.

(30) Foreign Application Priority Data

Jul. 8, 2024 (KR) ..... 10-2024-0089858

(51) Int. Cl.
*F04C 29/02* (2006.01)
*F04C 18/332* (2006.01)

(52) U.S. Cl.
CPC ..... *F04C 18/332* (2013.01); *F04C 29/02* (2013.01)

(58) Field of Classification Search
CPC .. F04C 18/332; F04C 18/344; F04C 18/3564; F04C 18/3568; F04C 29/02;
(Continued)

(56) References Cited

U.S. PATENT DOCUMENTS 6,132,195 A * 10/2000 Ikoma ..... F04C 18/3564 418/67
6,409,488 B1 * 6/2002 Ikoma ..... F04C 18/3564 418/67

(Continued)

FOREIGN PATENT DOCUMENTS

CN 201771763 U 3/2011
CN 204082542 U 1/2015

(Continued)

OTHER PUBLICATIONS

International Search Report and Written Opinion of the International Searching Authority dated Aug. 26, 2025 for International Application No. PCT/KR2025/005952.

*Primary Examiner* — Dapinder Singh
(74) *Attorney, Agent, or Firm* — STAAS & HALSEY LLP

(57) ABSTRACT

A compressor includes a housing, a cylinder, a roller, and a vane. The cylinder is inside the housing and has a cylinder chamber formed therein. The roller is configured to be rotatable in the cylinder chamber, and has a vane groove on an outer surface and an oil guide that extends between the vane groove and the inner surface of the roller. The oil guide guides oil within the vane groove. The vane is configured to be inserted and moved in the vane groove. The vane and the roller together partition the cylinder chamber into an inlet chamber into which a refrigerant is introduced and a compression chamber in which the refrigerant is compressed.

15 Claims, 19 Drawing Sheets

(58) Field of Classification Search
CPC ..... F04C 29/023; F04C 29/06; F04C 29/068; F04C 29/12; F04C 29/126; F04C 23/001; F04C 23/008; F04C 2240/10; F04C 2240/20; F04C 2240/30; F04C 2240/50
See application file for complete search history.

(56) References Cited

U.S. PATENT DOCUMENTS

| | | | | |
|---|---|---|---|---|
| 9,816,504 | B2 * | 11/2017 | Cho | F04C 18/0215 |
| 11,313,367 | B2 | 4/2022 | Kim et al. | |
| 11,448,216 | B2 * | 9/2022 | Park | F04C 23/008 |
| 12,123,414 | B2 | 10/2024 | Park et al. | |
| 2002/0159904 | A1 * | 10/2002 | Ebara | F04C 27/008 418/60 |
| 2005/0002814 | A1 * | 1/2005 | Kim | F04C 28/04 418/26 |
| 2021/0363991 | A1 * | 11/2021 | Park | F04C 18/3564 |
| 2024/0167476 | A1 * | 5/2024 | Park | F04C 29/028 |

FOREIGN PATENT DOCUMENTS

| | | | |
|---|---|---|---|
| CN | 104564687 | B | 1/2019 |
| CN | 110319018 | B | 11/2023 |
| JP | 7-259767 | | 10/1995 |
| JP | 10-148193 | | 6/1998 |
| KR | 10-2011-0128230 | | 11/2011 |
| KR | 10-2163622 | | 10/2020 |
| KR | 10-2310348 | | 10/2021 |
| KR | 10-2022-0136551 | | 10/2022 |

* cited by examiner

COMPRESSOR

CROSS-REFERENCE TO RELATED APPLICATIONS

This application is a continuation of International Application No. PCT/KR2025/005952, filed May 2, 2025, and claims priority to Korean Application No. 10-2024-0089858, filed Jul. 8, 2024, the disclosures of which are incorporated herein by reference in their entireties.

TECHNICAL FIELD

The present disclosure relates to a compressor.

BACKGROUND ART

A compressor is a mechanical device that receives power from a power generation device such as an electric motor or turbine to compress air, refrigerant, or other working gases to increase their pressure. The compressor is widely used in home appliances such as refrigerators, air conditioners, and clothes dryers, as well as in industries.

The types of compressors include a reciprocating compressor, a scroll compressor, and a rotary compressor. The reciprocating compressor forms a compression space, in which a working gas is drawn and discharged, between a piston and a cylinder, to allow the piston to reciprocate linearly in the cylinder so as to compress the working gas. The scroll compressor forms a compression chamber, in which a working gas is drawn and discharged, between an orbiting scroll and a fixed scroll, to allow the orbiting scroll to orbit with respect to the fixed scroll so as to compress the working gas. The rotary compressor forms a compression chamber, in which a working gas is drawn and discharged, between a rolling piston that rotates eccentrically and a cylinder, to allow the rolling piston to eccentrically rotate along an inner wall of the cylinder so as to compress the working gas.

The compressor includes a compressing portion in which compression of refrigerant is performed, and a driving portion that provides power for compressing the refrigerant. The compressing portion may be equipped with a muffler to reduce noise generated when the compressed refrigerant is discharged.

DISCLOSURE

Technical Problem

The present disclosure is directed to providing a compressor including an improved structure.

Further, the present disclosure is directed to providing a compressor having increased volumetric efficiency.

Further, the present disclosure is directed to providing a compressor having an extended life.

Further, the present disclosure is directed to providing a compressor capable of preventing damage to a vane.

Further, the present disclosure is directed to providing a compressor including an oil guide configured to guide oil within a vane groove.

Technical Solution

One aspect of the present disclosure provides a compressor including: a housing; a cylinder inside the housing and including a cylinder chamber formed therein; a roller configured to be rotatable in the cylinder chamber, the roller including a vane groove formed on an outer surface of the roller and an oil guide extending between the vane groove and an inner surface of the roller to guide oil within the vane groove; and a vane configured to be inserted and moved in the vane groove, wherein the vane and the roller together are configured to partition the cylinder chamber into an inlet chamber into which a refrigerant is introduced and a compression chamber into which the refrigerant is compressed.

Another aspect of the present disclosure provides a compressor including: an upper cylinder including an upper cylinder chamber; an upper roller configured to be rotatable in the upper cylinder chamber, the upper roller including an upper vane slot formed on an outer surface of the upper roller and an upper oil guide extending between the upper vane slot and an inner surface of the upper roller to guide oil within the upper vane slot, and the upper roller configured to compress a refrigerant flowing into the upper cylinder chamber as the upper roller rotates; an upper vane configured to be inserted and moved in the upper vane slot, wherein the upper vane and the upper roller together are configured to partition the upper cylinder chamber and configured to be movable in conjunction with the rotation of the upper roller; a lower cylinder arranged below the upper cylinder and including a lower cylinder chamber; a lower roller configured to be rotatable in the lower cylinder chamber, the lower roller including a lower vane slot formed on an outer surface of the lower roller and a lower oil guide extending between the lower vane slot and an inner surface of the lower roller to guide oil within the lower vane slot, and the lower roller configured to compress a refrigerant flowing into the lower cylinder chamber as the lower roller rotates; a lower vane configured to be inserted and moved in a lower vane slot, wherein the lower vane and the lower roller together are configured to partition the lower cylinder chamber and configured to be movable in conjunction with the rotation of the lower roller; and a rotating shaft configured to transmit rotational force to the upper roller and the lower roller.

Another aspect of the present disclosure provides a compressor including: a housing; a cylinder disposed inside the housing and including a cylinder chamber; a roller configured to be rotatable in the cylinder chamber, and configured to compress a refrigerant flowing into the cylinder chamber as the roller rotates; a rotating shaft configured to provide rotational force to the roller and disposed to penetrate the roller; and a vane including a first end fixed to the cylinder and a second end configured to be movable by the rotation of the roller. The roller includes: an oil guide to guide oil to flow between the vane groove and an opening of the oil guide on the inner surface of the roller toward the rotating shaft.

ADVANTAGEOUS EFFECTS

MODES OF THE INVENTION

Figure 1:
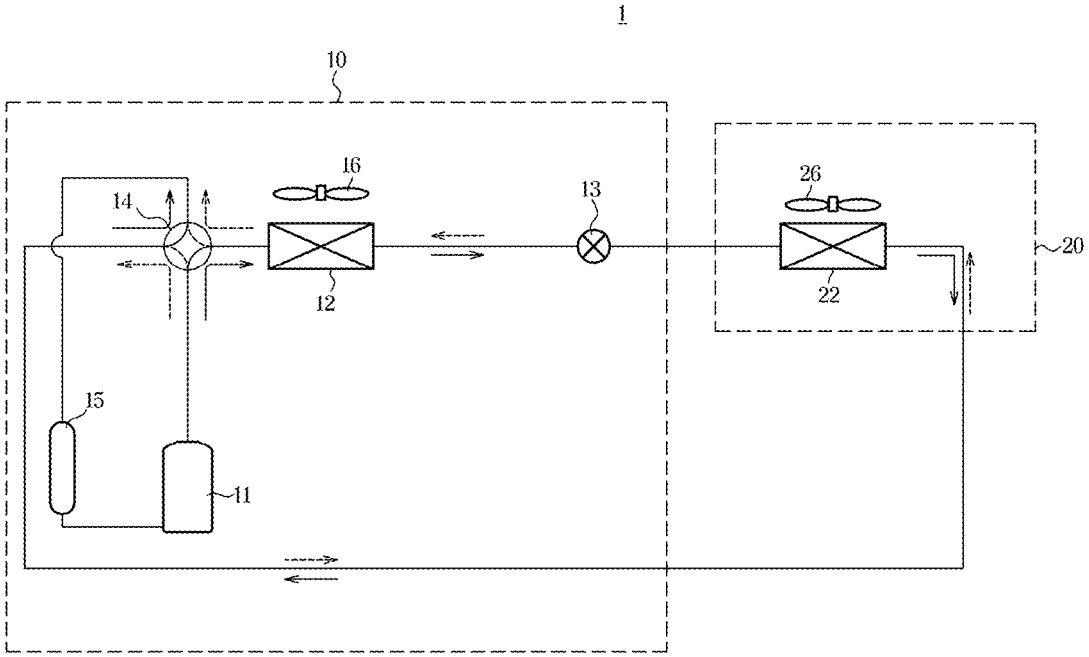
FIG. 1 schematically illustrates an example of an air conditioner including a compressor according to one embodiment of the present disclosure.

The various embodiments and the terms used therein are not intended to limit the technology disclosed herein to specific forms, and the disclosure should be understood to include various modifications, equivalents, and/or alternatives to the corresponding embodiments.

In describing the drawings, similar reference numerals may be used to designate similar constituent elements.

A singular expression may include a plural expression unless otherwise indicated herein or clearly contradicted by context.

The expressions "A or B," "at least one of A or/and B," or "one or more of A or/and B," A, B or C," "at least one of A, B or/and C," or "one or more of A, B or/and C," and the like used herein may include any and all combinations of one or more of the associated listed items.

The term of "and/or" includes a plurality of combinations of relevant items or any one item among a plurality of relevant items.

The terms such as "unit", "module", and "member" may be embodied as hardware or software. According to embodiments, a plurality of "unit", "module", and "member" may be implemented as a single component or a single "unit", "module", and "member" may include a plurality of components.

Herein, the term "a first", "a second", "the first", "the second", etc., may simply be used to distinguish an element from other elements, but is not limited to another aspect (importance or order) of elements.

When an element (e.g., a first element) is referred to as being "(functionally or communicatively) coupled," or "connected" to another element (e.g., a second element), the first element may be connected to the second element, directly (e.g., wired), wirelessly, or through a third element.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the description, when an element is "on" another element, this includes not only when the element is in contact with the other element, but also when there is another element between the two elements.

In the following detailed description, the terms of "upper", "lower", "vertical direction" and the like may be defined based on the drawings, but the shape and the location of the element is not limited by the term.

In the following detailed description, "upper ~", "lower ~", and the like may be used to distinguish components by considering the relative positions between the components, and these expressions may be replaced with expressions such as "first ~", "second ~".

The disclosure will be described more fully hereinafter with reference to the accompanying drawings.

FIG. 1 schematically illustrates an example of an air conditioner including a compressor according to one embodiment of the present disclosure.

Referring to FIG. 1, a compressor 11 according to one embodiment of the present disclosure may be included in an air conditioner 1.

For cooling a space to be air-conditioned, i.e., indoors, the air conditioner 1 may absorb heat from the indoors and release heat to the outdoors. In addition, the air conditioner 1 may absorb heat from the outdoors and release heat to the outdoors for heating the indoors. The air conditioner 1 may include an outdoor unit 10 configured to exchange heat with outdoor air, and an indoor unit 20 configured to exchange heat with indoor air. For example, the outdoor unit 10 may be installed in an outdoor space and exchange heat with outdoor air, and the indoor unit 20 may be installed in an indoor space and exchange heat with indoor air.

The air conditioner 1 according to one embodiment may be a separate air conditioner in which the outdoor unit 10 and the indoor unit 20 are installed separately from each other. Alternatively, the air conditioner 1 according to one embodiment may be an integrated air conditioner in which the outdoor unit 10 and the indoor unit 20 are installed together in one cabinet.

The outdoor unit 10 may perform heat exchange between a refrigerant and outdoor air by utilizing the phase change of the refrigerant (e.g., evaporation or condensation). For example, the outdoor unit 10 may release the heat of the refrigerant to the outdoor air by utilizing the condensation of the refrigerant. In addition, the outdoor unit 10 may absorb the heat of the outdoor air into the refrigerant by utilizing the evaporation of the refrigerant.

The outdoor unit 10 may include the compressor 11 configured to compress a refrigerant. The outdoor unit 10 may include an outdoor heat exchanger 12 configured to exchange heat between outdoor air and the refrigerant.

The indoor unit 20 may perform heat exchange between a refrigerant and indoor air by utilizing the phase change of the refrigerant (e.g., evaporation or condensation). For example, the indoor unit 20 may cool an indoor space by absorbing the heat of the indoor air into the refrigerant by utilizing the evaporation of the refrigerant. In addition, the indoor unit 20 may heat the indoor space by releasing the heat of the refrigerant into the indoor air by utilizing the condensation of the refrigerant.

The indoor unit 20 may include an indoor heat exchanger 22 configured to exchange heat between indoor air and a refrigerant.

As illustrated in FIG. 1, the air conditioner 1 may include a refrigerant circulation circuit for transferring heat between the outdoor unit 10 and the indoor unit 20 using a refrigerant.

The refrigerant circulation circuit may include the compressor 11, the outdoor heat exchanger 12, an expansion device 13, and the indoor heat exchanger 22. The refrigerant may circulate by passing through the compressor 11, the outdoor heat exchanger 12, the expansion device 13, and the indoor heat exchanger 22, sequentially, or may circulate by passing through the compressor 11, the indoor heat exchanger 22, the expansion device 13, and the outdoor heat exchanger 12, sequentially.

The compressor 11 may compress a refrigerant. A low-temperature and low-pressure refrigerant may be introduced into the compressor 11. The compressor 11 may compress the low-temperature and low-pressure refrigerant to change into a high-temperature and high-pressure refrigerant. The compressor 11 may discharge the high-temperature and high-pressure refrigerant.

In the outdoor heat exchanger 12, heat exchange between the refrigerant and the outdoor air may perform. For example, during a cooling operation, the outdoor heat exchanger 12 may condense the high-temperature and high-pressure refrigerant, and while the refrigerant is condensed, the refrigerant may release heat to the indoor air. During the cooling operation, the outdoor heat exchanger 12 may discharge a refrigerant liquid. In addition, during a heating operation, the outdoor heat exchanger 12 may evaporate a low-temperature and high-pressure refrigerant, and while the refrigerant is evaporated, the refrigerant may absorb heat from the indoor air. During the heating operation, the outdoor heat exchanger 12 may discharge a refrigerant gas.

An outdoor fan 16 may be disposed adjacent to the outdoor heat exchanger 12. The outdoor fan 16 may blow outdoor air to the outdoor heat exchanger 12 to promote the heat exchange between the refrigerant and the outdoor air.

The expansion device 13 may expand the refrigerant. For example, the expansion device 13 may expand the high-temperature and high-pressure refrigerant liquid by using the throttling effect. The expansion device 13 may discharge the low-temperature and low-pressure refrigerant liquid. The expansion device 13 may include an orifice configured to reduce a cross-sectional area of a flow path.

The expansion device 13 may be connected to the indoor unit 20. The expansion device 13 may be provided in a number corresponding to the number of indoor units 20.

In the indoor heat exchanger 22, the heat exchange between the refrigerant and indoor air may perform. For example, during the cooling operation, a low-pressure and low-temperature refrigerant may evaporate in the indoor heat exchanger 22, and while the refrigerant is evaporated, the refrigerant may absorb heat from the indoor air. During the cooling operation, the indoor heat exchanger 22 may discharge a refrigerant gas. In addition, during the heating operation, a high-temperature and high-pressure refrigerant may be condensed in the indoor heat exchanger 22, and while the refrigerant is condensed, the refrigerant may release heat to the indoor air. During the heating operation, the indoor heat exchanger 22 may discharge a refrigerant liquid.

According to embodiments, a separate expansion device (not shown) or a capillary tube (not shown) may be provided on an inlet side of the indoor heat exchanger 22. The separate expansion valve or the capillary tube may expand a refrigerant liquid and provide a low-temperature and low-pressure refrigerant liquid to the indoor heat exchanger 22.

An indoor fan 26 may be disposed adjacent to the indoor heat exchanger 22. The indoor fan 26 may blow indoor air to the indoor heat exchanger 22 to promote the heat exchange between the refrigerant and the outdoor air.

Further, the refrigerant circulation circuit may further include a flow switching valve 14. For example, the flow switching valve 14 may include a 4-way valve. The flow switching valve 14 may be connected to a refrigerant outlet of the compressor 11.

The flow switching valve 14 may switch a circulation path of a refrigerant depending on the operation mode (e.g., the cooling operation or the heating operation) of the air conditioner 1. For example, during the cooling operation of the air conditioner 1, the flow switching valve 14 may guide the refrigerant discharged from the compressor 11 to the outdoor heat exchanger 12, and thus the refrigerant may be circulated in the order of the compressor 11, the outdoor heat exchanger 12, the expansion device 13, and the indoor heat exchanger 22. In addition, during the heating operation of the air conditioner 1, the flow switching valve 14 may guide the refrigerant discharged from the compressor 11 to the indoor heat exchanger 22, and thus the refrigerant may be circulated in the order of the compressor 11, the indoor heat exchanger 22, the expansion device 13, and the outdoor heat exchanger 12.

Further, the refrigerant circulation circuit may further include an accumulator 15. The accumulator 15 may be connected to a refrigerant inlet of the compressor 11.

The low-temperature and low-pressure refrigerant evaporated in the indoor heat exchanger 22 or the outdoor heat exchanger 12 may be introduced into the accumulator 15. For example, during the cooling operation, the low-temperature and low-pressure refrigerant evaporated in the indoor heat exchanger 22 may be introduced into the accumulator 15. During the heating operation, the low-temperature and low-pressure refrigerant evaporated in the outdoor heat exchanger 12 may be introduced into the accumulator 15.

Depending on a load, the refrigerant may be incompletely evaporated in the indoor heat exchanger 22 or the outdoor heat exchanger 12, and a refrigerant, in which a refrigerant liquid and a refrigerant gas are mixed, may flow into the accumulator 15. When the refrigerant, in which the refrigerant liquid and the refrigerant gas are mixed, flows into the accumulator 15, the accumulator may separate the refrigerant liquid from the refrigerant gas, and provide the refrigerant gas, from which the refrigerant liquid is separated, to the compressor 11.

For example, the compressor 11, the outdoor heat exchanger 12, the outdoor fan 16, the expansion device 13, the flow switching valve 14, and the accumulator 15 may be disposed in the outdoor unit 10. The indoor heat exchanger 22 and the indoor fan 26 may be disposed in the indoor unit 20. However, the location of the expansion device 13 is not limited to the outdoor unit 10, and in various embodiments, the expansion device 13 may be disposed in the indoor unit 20.

FIG. 1 illustrates an example in which a single outdoor unit 10 and a single indoor unit 20 are connected to each other, but the present disclosure is not limited thereto. Alternatively, a single outdoor unit 10 and two or more indoor units 20 may be connected, or two or more outdoor units 10 and a single indoor unit 20 may be connected, or two or more outdoor units 10 and two or more indoor units 20 may be connected.

The air conditioner 1 described above with reference to FIG. 1 is only an example of an apparatus, to which the compressor according to the present disclosure is applied, and the present disclosure is not limited thereto.

Figure 2:
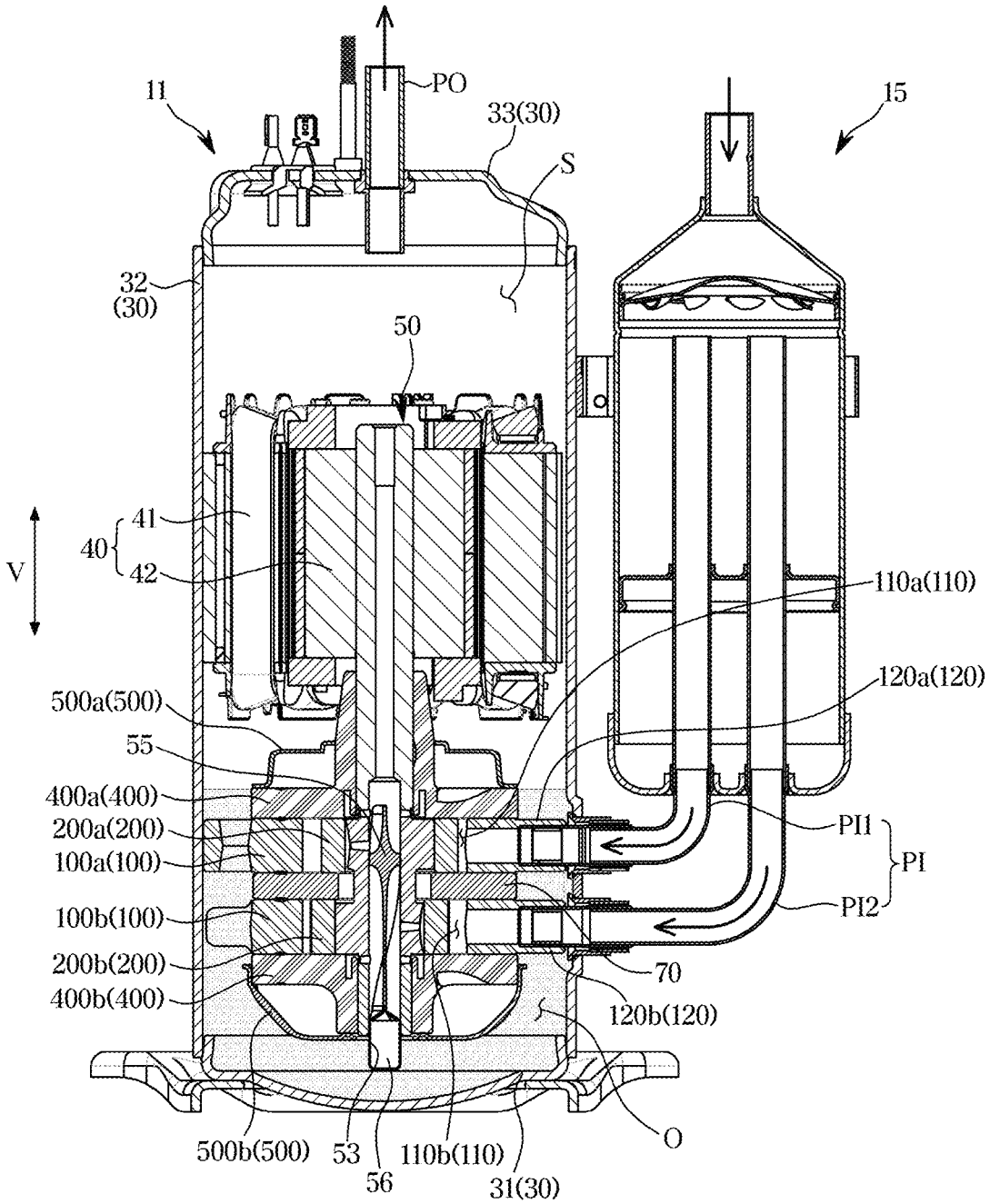
FIG. 2 is a cross-sectional view of the compressor and an accumulator according to one embodiment of the present disclosure.

FIG. 2 is a cross-sectional view of the compressor and an accumulator according to one embodiment of the present disclosure.

Referring to FIG. 2, the compressor 11 according to one embodiment of the present disclosure may include a compressing portion (including components such as a cylinder 100, a roller 200, etc.) configured to compress a refrigerant. The compressor 11 according to one embodiment of the present disclosure may include a drive motor 40 configured to provide power to the compressing portion. The compressor 11 according to one embodiment of the present disclosure may include a housing 30 that accommodates the compressing portion and the drive motor 40.

The housing 30 may form an exterior of the compressor 11. The housing 30 may be provided to accommodate the components of the compressor 11. An accommodation space S in which the compressing portion and the drive motor 40 are accommodated may be formed inside the housing 30.

The housing 30 may be provided to accommodate oil O. The housing 30 may be provided to store oil O. The oil O may reduce friction between various components of the compressor 11 and lubricate the various components of the compressor 11.

A compressor inlet pipe PI may be connected to an inlet portion of the housing 30. The housing 30 may be connected to the accumulator 15 through the compressor inlet pipe PI. The compressor inlet pipe PI may be provided to guide a refrigerant flowing from the accumulator 15 into an inside of the housing 30. The compressor inlet pipe PI may be connected to the cylinder 100, and the refrigerant guided by the compressor inlet pipe PI may flow into a cylinder chamber 110 inside the cylinder 100.

For example, when the compressor 11 includes an upper cylinder 100*a* and a lower cylinder 100*b*, the compressor inlet pipe PI may include an upper cylinder inlet pipe PI1 connected to the upper cylinder 100*a* and a lower cylinder inlet pipe PI2 connected to the lower cylinder 100*b*.

A compressor outlet pipe PO may be connected to an outlet portion of the housing 30. The compressor outlet pipe PO may discharge the compressed refrigerant within the housing 30. The outlet pipe PO may be provided to guide the refrigerant discharged from the inside of the housing 30 to the outside of the housing 30. The compressor outlet pipe PO may be provided to guide the refrigerant within the accommodation space S of the housing 30 to be discharged to the outside of the housing 30.

For example, the housing 30 may include a base 31, a side frame 32, and a top cover 33. The base 31 may form a lower exterior of the housing 30. The side frame 32 may form a side wall of the housing 30. The top cover 33 may form an upper exterior of the housing 30. At least some of the base 31, the side frame 32, and the top cover 33 may be detachably coupled. At least some of the base 31, the side frame 32, and the top cover 33 may be formed integrally.

The drive motor 40 may generate power. The drive motor 40 may generate rotational force. The drive motor 40 may convert electromagnetic force into mechanical rotational force.

The drive motor 40 may include a stator 41 fixed to the housing 30 and a rotor 42 rotatable with respect to the stator 41. The stator 41 may include a stator core and a coil wound around the stator core. The rotor 42 may include a plurality of magnets. In the drawing, an inner rotor type drive motor 40, in which the rotor 42 is disposed inside the stator 41, is illustrated, but the present disclosure is not limited thereto. The drive motor 40 may also be an outer rotor type in which the rotor 42 is disposed outside the stator 41. As long as the drive motor 40 generates power, there is no limitation on the type of the drive motor 40.

For example, the drive motor 40 may be disposed above the compressing portion.

The compressor 11 may include a rotating shaft 50. The rotating shaft 50 may be configured to transmit power generated from the drive motor 40 to the compressing portion. The rotating shaft 50 may be provided to connect the drive motor 40 and the compressing portion. The rotating shaft 50 may be connected to the rotor 42. The rotating shaft 50 may be provided to be fixed to the rotor 42 and rotate together with the rotor 42. The rotating shaft 50 may be connected to the roller 200 of the compressing portion, which will be described later. The rotating shaft 50 may be configured to provide rotational force to the roller 200. For example, the rotating shaft 50 may be configured to transmit rotational force to an upper roller 200*a* and a lower roller 200*b* which will be described later.

The rotating shaft 50 may extend along a vertical direction V. The rotating shaft 50 may extend along an up and down direction. The rotating shaft 50 may extend along the gravity direction. The rotating shaft 50 may extend along a height direction of the compressor 11.

The rotating shaft 50 may be provided to penetrate components of the compressing portion. For example, the rotating shaft 50 may be provided to penetrate a muffler 500, a cylinder cover 400, the cylinder 100, and the roller 200, which will be described later, in a substantially vertical direction V. For example, the rotating shaft 50 may be provided to penetrate an upper muffler 500*a*, an upper cylinder cover 400*a*, an upper cylinder 100*a*, the upper roller 200*a*, a mid-plate 70, a lower cylinder 100*b*, the lower roller 200*b*, a lower cylinder cover 400*b*, and a lower muffler 500*b* in the substantially vertical direction V.

The compressor 11 may include a cam 60. The cam 60 may be provided on an outer surface of the rotating shaft 50. The cam 60 may be configured to transmit the rotational force of the rotating shaft 50 to the compressing portion.

The compressor 11 may include at least one cylinder 100, at least one roller 200, at least one vane 300, at least one cylinder cover 400, at least one muffler 500, and at least one cam 60. In the drawing, it is illustrated that two cylinders 100, two rollers 200, two vanes 300, two cylinder covers 400, two mufflers 500, and two cams 60 are provided. However, the drawing only illustrates an example of the compressor 11. Alternatively, the compressor 11 may include a single cylinder 100, a single roller 200, a single vane 300, a single cylinder cover 400, a single muffler 500, and a single cam 60. Alternatively, the compressor 11 may include three or more cylinders 100, three or more rollers 200, three or more vanes 300, three or more cylinder covers 400, three or more mufflers 500, and three or more cams 60.

Meanwhile, the terms "upper ~" and "lower ~" may be used to distinguish between the plurality of components included in the compressor 11. A component for which the term "upper ~" is used may be indicated with a drawing symbol "a", and a component for which the term "lower ~" is used may be indicated with a drawing symbol "b". For example, when the compressor 11 includes two cylinders 100, a cylinder positioned relatively above among the two cylinders may be referred to as an upper cylinder 100*a*, and a cylinder positioned relatively below among the two cylinders may be referred to as a lower cylinder 100*b*. When there is no need to distinguish between the plurality of components included in the compressor 11, the terms "upper ~" and "lower ~" may not be used. For example, a description of the cylinder 100 may be a description common to both the upper cylinder 100*a* and the lower cylinder 100*b*. In addition, the above-described contents are applied not only to the cylinder 100, but also to the roller 200, the vane 300, the cylinder cover 400, the muffler 500, and the cam 60.

In other words, a description of the cylinder 100 may be applied to each of the upper cylinder 100*a* and the lower cylinder 100*b*. A description of the roller 200 may be applied to each of the upper roller 200*a* and the lower roller 200*b*. A description of the vane 300 may be applied to each of an upper vane 300*a* and a lower vane 300*b*. A description of the cylinder cover 400 may be applied to each of the upper cylinder 400*a* and the lower cylinder 400*b*. A description of the muffler 500 may be applied to each of the upper muffler 500*a* and the lower muffler 500*b*. A description of the cam 60 may be applied to each of an upper cam 60*a* and a lower cam 60*b*.

Figure 3:
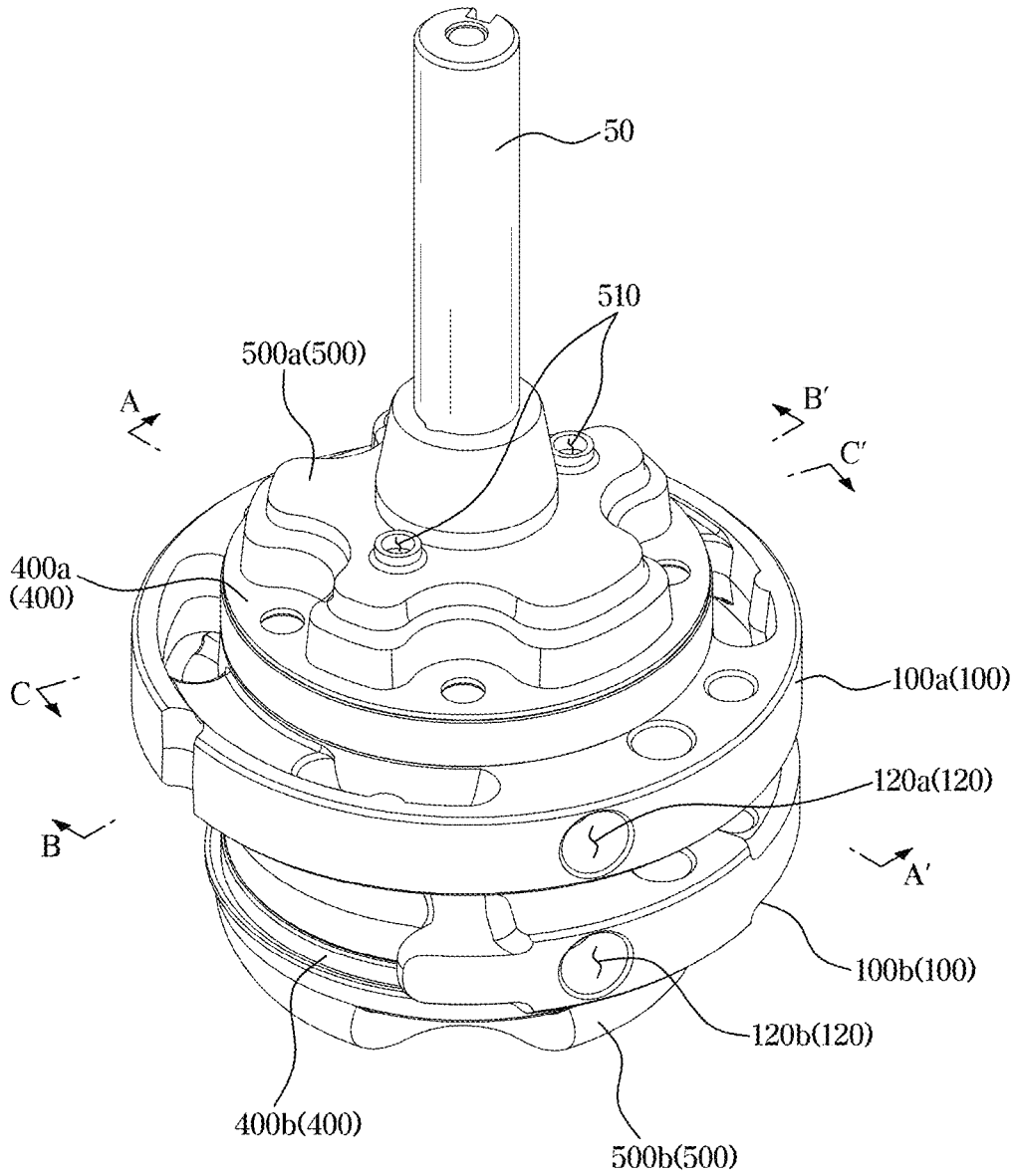
FIG. 3 illustrates some components of the compressor according to one embodiment of the present disclosure.
Figure 4:
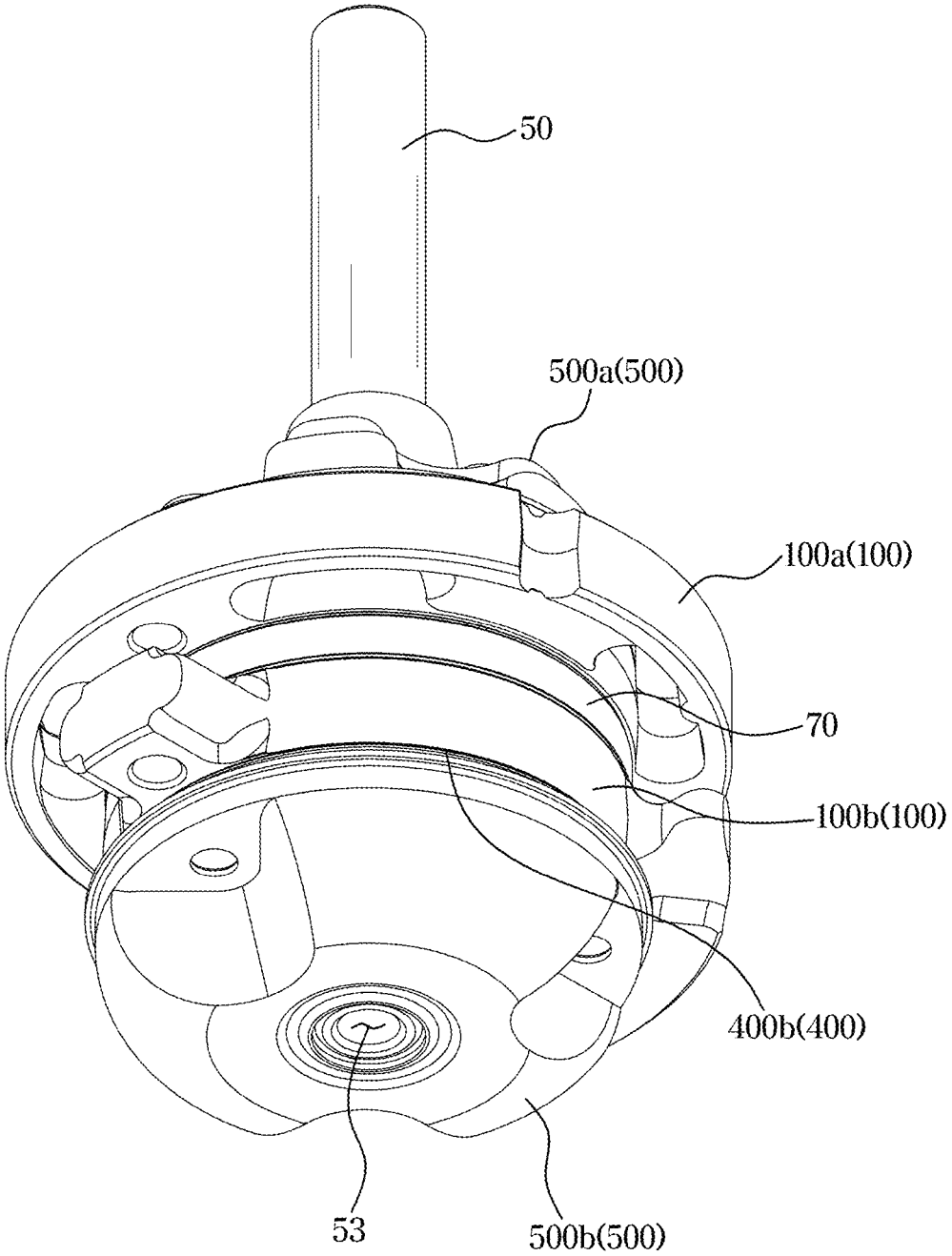
FIG. 4 illustrates some components of the compressor illustrated in FIG. 3 when viewed in a different direction from the direction illustrated in FIG. 3.
Figure 5:
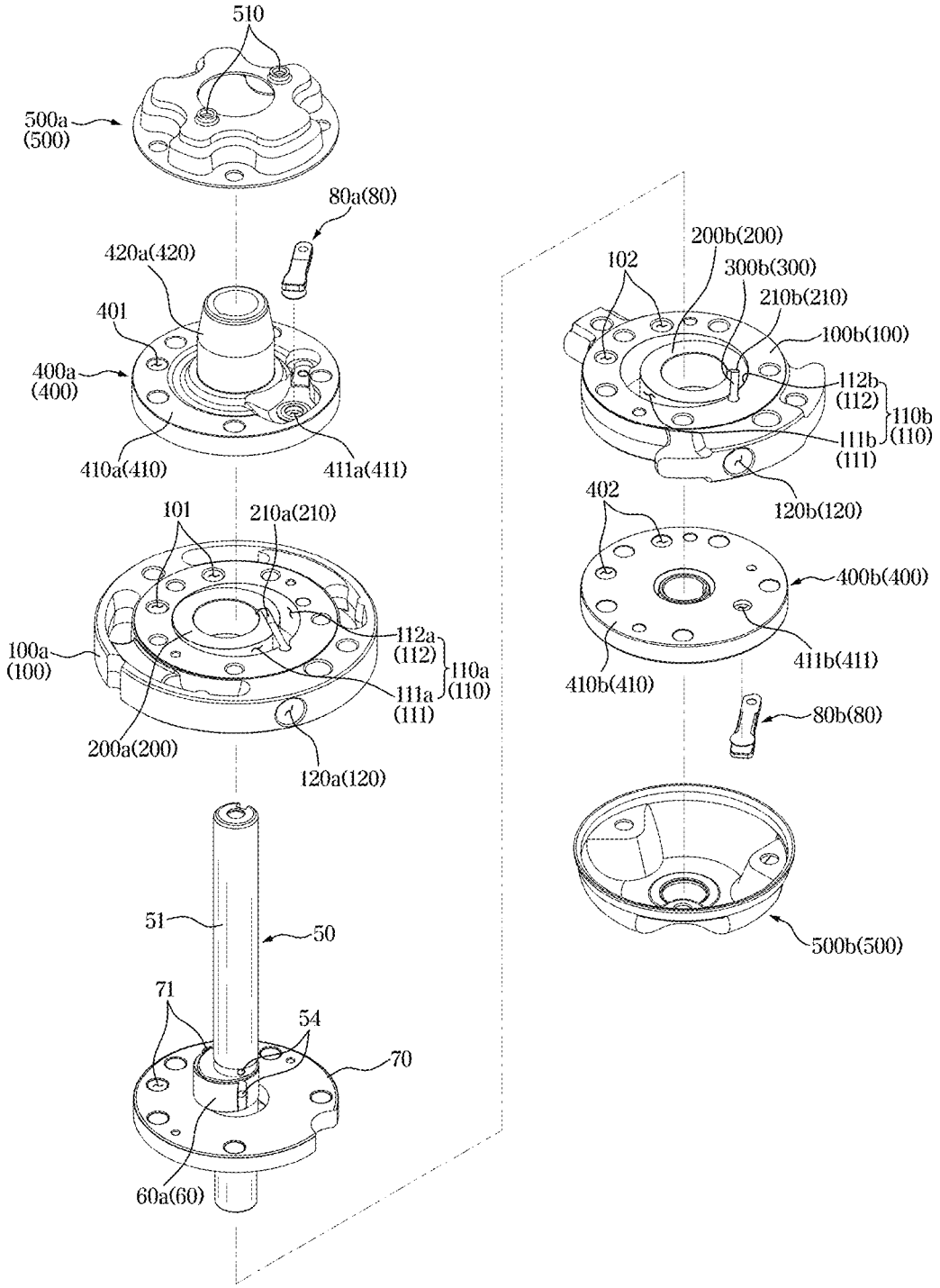
FIG. 5 is an exploded view of some components of the compressor illustrated in FIG. 3.
Figure 6:
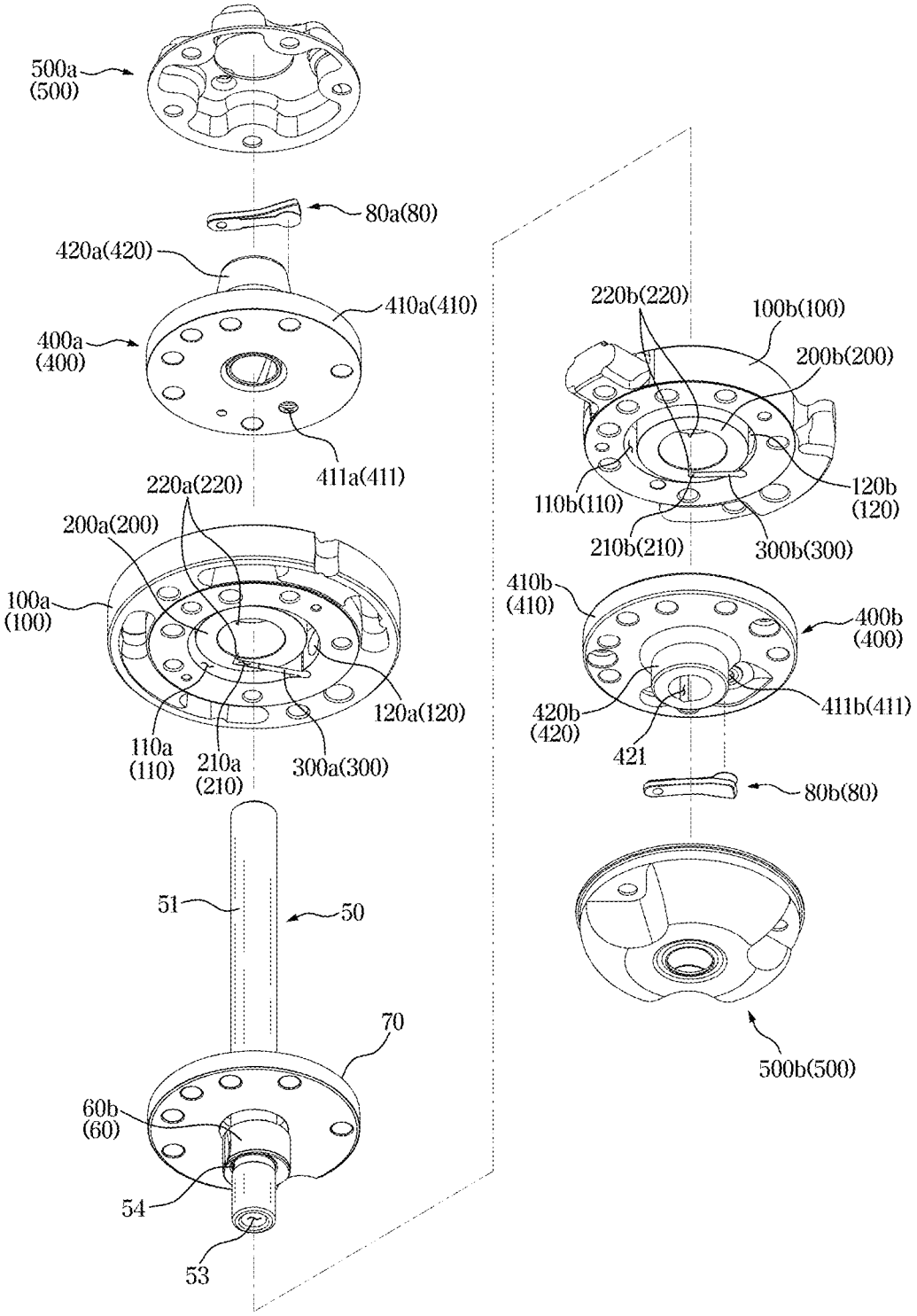
FIG. 6 is an exploded view of some components of the compressor illustrated in FIG. 3 when viewed in a different direction from the direction illustrated in FIG. 5.
Figure 7:
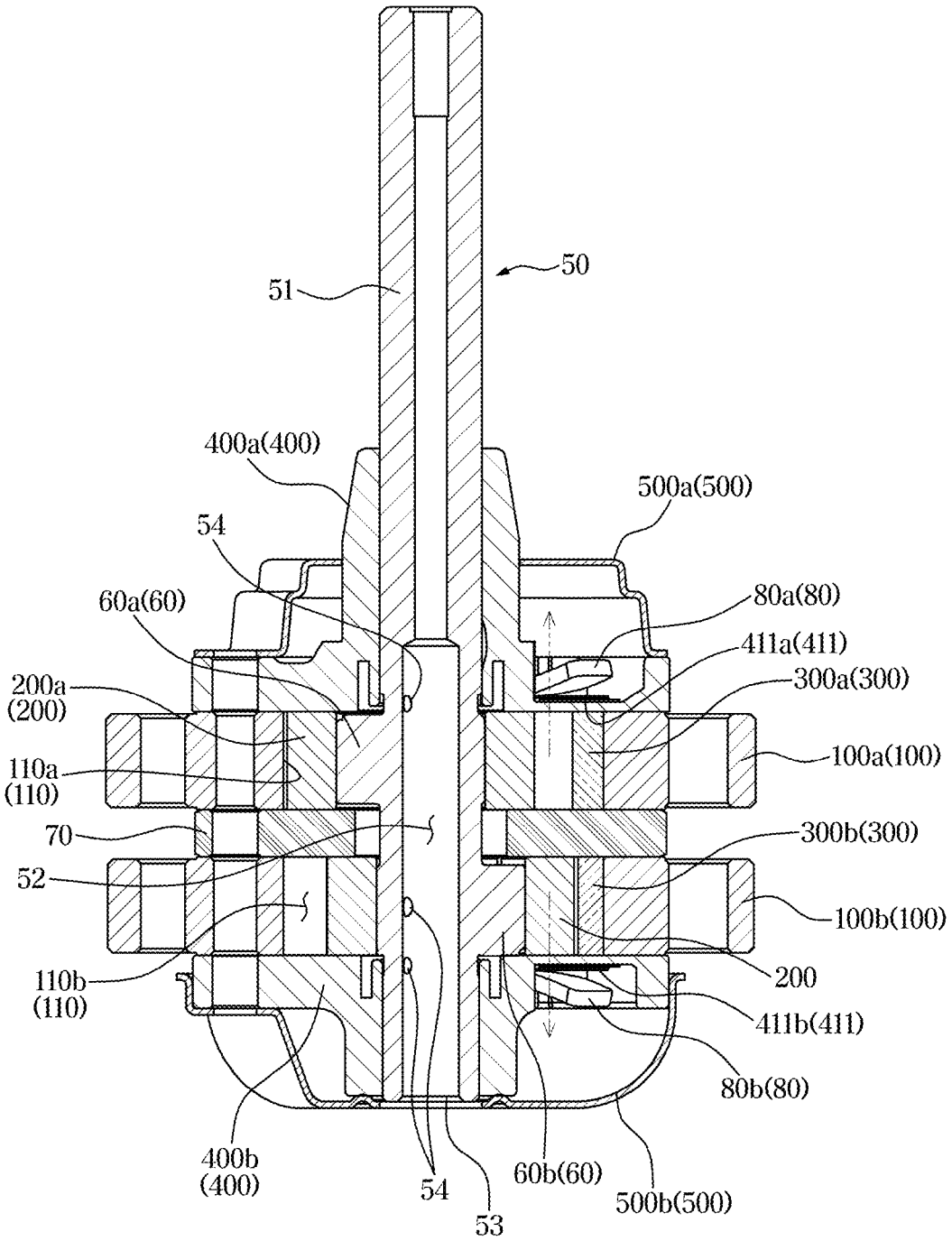
FIG. 7 is a cross-sectional view taken along line A-A' illustrated in FIG. 3.
Figure 8:
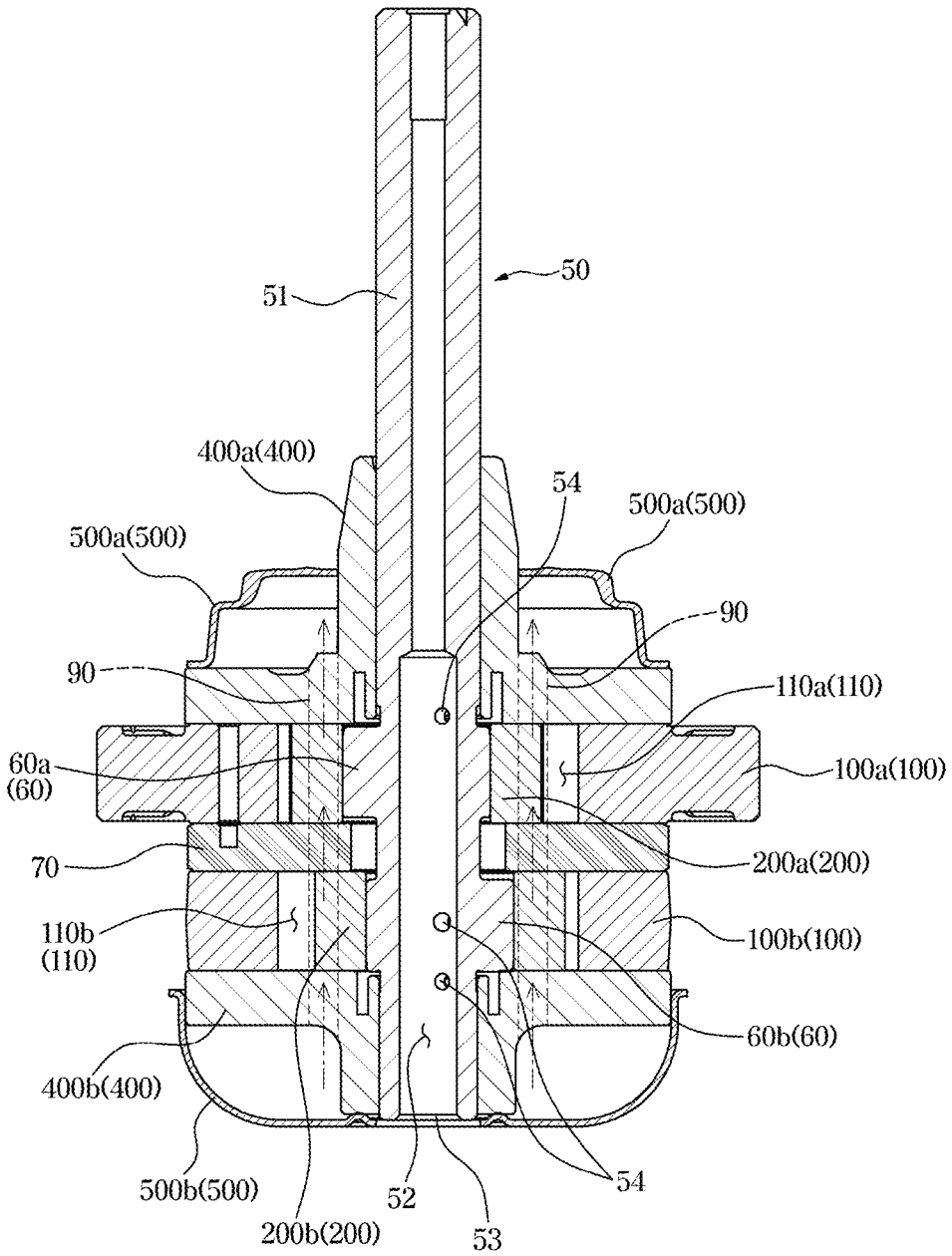
FIG. 8 is a cross-sectional view taken along line B-B' illustrated in FIG. 3.

FIG. 3 illustrates some components of the compressor according to one embodiment of the present disclosure. FIG. 4 illustrates some components of the compressor illustrated in FIG. 3 when viewed in a different direction from the direction illustrated in FIG. 3. FIG. 5 is an exploded view of some components of the compressor illustrated in FIG. 3. FIG. 6 is an exploded view of some components of the compressor illustrated in FIG. 3 when viewed in a different direction from the direction illustrated in FIG. 5. FIG. 7 is a cross-sectional view taken along line A-A' illustrated in FIG. 3. FIG. 8 is a cross-sectional view taken along line B-B' illustrated in FIG. 3.

Some components of the compressor 11 will be described with reference to FIGS. 3 to 8. An example will be given of a case in which two cylinders 100, two rollers 200, two vanes 300, two cylinder covers 400, two mufflers 500, and two cams 60 are provided. However, as described above, the present disclosure is not limited to the example.

The compressor 11 may include at least one cylinder 100.

The cylinder 100 may include the cylinder chamber 110. The cylinder chamber 110 may accommodate a refrigerant. The refrigerant discharged from the accumulator 15 (refer to FIGS. 1 and 2) may flow into the cylinder chamber 110 and be compressed in the cylinder chamber 110. The cylinder chamber 110 may be formed on the inside of the cylinder 100. For example, the cylinder 100 may have a substantially ring shape, and the cylinder chamber 110 may be formed on an inner portion of the ring shape of the cylinder 100. The cylinder chamber 110 may include an inlet chamber 111 into which the refrigerant is introduced, and a compression chamber 112 into which the introduced refrigerant is compressed.

The cylinder 100 may include an inlet 120 into which a refrigerant is introduced. The inlet 120 may be connected to the compressor inlet pipe PI (refer to FIG. 2). The refrigerant flowing along the compressor inlet pipe PI may flow into the cylinder chamber 110 through the inlet 120. The inlet 120 may be provided to communicate with the cylinder chamber 110. Particularly, the inlet 120 may be provided to communicate with the inlet chamber 111 of the cylinder chamber 110.

For example, the compressor 11 may include the upper cylinder 100*a* and the lower cylinder 100*b*. The upper cylinder 100*a* may be positioned above the lower cylinder 100*b*. The lower cylinder 100*b* may be positioned below the upper cylinder 100*a*.

The mid-plate 70 may be disposed between the upper cylinder 100*a* and the lower cylinder 100*b*.

The upper cylinder 100*a* may include an upper cylinder chamber 110*a*. The upper cylinder chamber 110*a* may include an upper inlet chamber 111*a* into which the refrigerant is introduced, and an upper compression chamber 112*a* into which the introduced refrigerant is compressed. The upper cylinder chamber 110*a* may be formed on an inner side of the upper cylinder 100*a*. For example, the upper cylinder chamber 110*a* may be defined as a space surrounded by an outer surface of the upper roller 200*a*, an inner surface of the upper cylinder 100*a*, the upper cylinder 400*a*, and the mid-plate 70.

The upper cylinder 100*a* may include an upper inlet 120*a* into which the refrigerant is introduced. The upper inlet 120*a* may be connected to the upper cylinder inlet pipe PI1 (refer to FIG. 2). The upper inlet 120*a* may communicate with the upper cylinder chamber 110*a*. The upper inlet 120*a* may communicate with the upper inlet chamber 111*a*.

The lower cylinder 100*b* may include a lower cylinder chamber 110*b*. The lower cylinder chamber 110*b* may include a lower inlet chamber 111*b* into which the refrigerant is introduced, and a lower compression chamber 112*b* into which the introduced refrigerant is compressed. The lower cylinder chamber 110*b* may be formed on an inner side of the lower cylinder 100*b*. For example, the lower cylinder chamber 110*b* may be defined as a space surrounded by an outer surface of the lower roller 200*b*, an inner surface of the lower cylinder 100*b*, the lower cylinder 400*b*, and the mid-plate 70.

The lower cylinder 100*b* may include a lower inlet 120*b* into which the refrigerant is introduced. The lower inlet 120*b* may be connected to the lower cylinder inlet pipe PI2 (refer to FIG. 2). The lower inlet 120*b* may communicate with the lower cylinder chamber 110*b*. The lower inlet 120*b* may communicate with the lower inlet chamber 111*b*.

The compressor 11 may include the mid-plate 70 positioned between the upper cylinder 100*a* and the lower cylinder 100*b*.

The mid-plate 70 may be positioned below the upper cylinder 100*a* to cover a lower side of the upper cylinder chamber 110*a*. The mid-plate 70 may be positioned above the lower cylinder 100*a* to cover an upper side of the lower cylinder chamber 110*b*. The mid-plate 70 may be provided to define the upper cylinder chamber 110*a* and the lower cylinder chamber 110*b*.

The mid-plate 70 may be coupled to the upper cylinder 100*a* and/or the lower cylinder 100*b*. For example, the mid-plate 70 may be screw-coupled to the upper cylinder 100*a* and/or the lower cylinder 100*b*. However, the present disclosure is not limited to the above-described example, and the mid-plate 70 may be coupled to the upper cylinder 100*a* and/or the lower cylinder 100*b* through various known coupling methods.

The compressor 11 may include at least one roller 200. For example, the number of rollers 200 may correspond to the number of cylinders 100.

The roller 200 may be configured to be rotatable in the cylinder chamber 110. The roller 200 may be configured to compress the refrigerant flowing into the cylinder chamber 110 as the roller 200 rotates in the cylinder chamber 110. The roller 200 may receive rotational force from the rotating shaft 50. The roller 200 may be eccentric with respect to a central axis of the rotating shaft 50 by the cam 60 to be described later. The roller 200 may rotate around the eccentric axis.

The roller 200 may have a substantially ring shape. An outer diameter of the roller 200 may be less than an inner diameter of the cylinder 100. An outer surface of the roller 200 may rotate while being in contact with an inner surface of the cylinder 100.

The roller 200 may include a vane groove 210 into which a portion of the vane 300 is insertable. The vane groove 210 may be formed by being recessed from the outer surface of the roller 200. A detailed description of the vane groove 210 will be described later.

The roller 200 may include an oil guide 220 provided to open toward the inside of the roller 200 from the vane groove 210. The oil guide 220 may open toward the rotating shaft 50. The oil guide 220 may extend from the vane groove 210 to the inner surface of the roller 200. A detailed description of the oil guide 220 will be described later.

For example, the compressor 11 may include the upper roller 200*a* and the lower roller 200*b*. The upper roller 200*a* may be positioned above the lower roller 200*b*. The lower roller 200*b* may be positioned below the upper roller 200*a*.

The upper roller 200*a* may be configured to be rotatable in the upper cylinder chamber 110*a*. The upper roller 200*a* may be configured to compress a refrigerant flowing into the upper cylinder chamber 110*a* as the upper roller 200*a* rotates. The upper roller 200*a* may be configured to rotate eccentrically by the upper cam 60*a* formed on the outer surface of the rotating shaft 50.

The upper roller 200*a* may include an upper vane groove 210*a* into which a portion of the upper vane 300*a* is insertable. The upper vane groove 210*a* may be formed by being recessed from the outer surface of the upper roller 200*a*.

The upper roller 200*a* may include an upper oil guide 220*a* provided to open from the upper vane groove 210*a* toward the rotating shaft 50. The upper oil guide 220*a* may extend from the upper vane groove 210*a* to the inner surface of the upper roller 200*a*.

The lower roller 200*b* may be configured to be rotatable in the lower cylinder chamber 110*b*. The lower roller 200*b* may be configured to compress a refrigerant flowing into the lower cylinder chamber 110*b* as the lower roller 200*b* rotates. The lower roller 200*b* may be configured to rotate eccentrically by the lower cam 60*b* formed on the outer surface of the rotating shaft 50.

The lower roller 200*b* may include a lower vane groove 210*b* into which a portion of the lower vane 300*b* is insertable. The lower vane groove 210*b* may be formed by being recessed from the outer surface of the lower roller 200*b*.

The lower roller 200*b* may include a lower oil guide 220*b* provided to open from the lower vane groove 210*b* toward the rotating shaft 50. The lower oil guide 220*b* may extend from the lower vane groove 210*b* to the inner surface of the lower roller 200*b*.

The compressor 11 may include the rotating shaft 50.

The rotating shaft 50 may include a shaft body 51, a suction hole 53, and a discharge hole 54.

The shaft body 51 may form an oil flow path 52. The shaft body 51 may have a hollow shape to allow oil to flow inside the shaft body 51. The oil flow path 52 may extend along a longitudinal direction of the shaft body 51. The oil flow path 52 may extend along the substantially vertical direction V.

The suction hole 53 may be formed at a lower end of the shaft body 51. The suction hole 53 may be provided at one end of the oil flow path 52. The suction hole 53 may be provided to draw oil O accommodated in the housing 30 into the oil flow path 52. The suction hole 53 may open toward a bottom of the housing 30.

For example, the rotating shaft 50 may include a paddle 55 provided inside the shaft body 51 and a pickup member 56 provided in the suction hole 53 to draw oil O accommodated in the housing 30 (refer to FIG. 2). However, the present disclosure is not limited to the above-described example, and the rotating shaft 50 may draw in oil O through various known methods.

The discharge hole 54 may be provided to discharge oil flowing along the oil flow path 52. The discharge hole 54 may allow the oil flow path 52 of the shaft body 51 to communicate with an outer surface of the shaft body 51. Oil discharged through the discharge hole 54 may flow between the components of the compressing portion of the compressor 11.

The rotating shaft 50 may include a plurality of discharge holes 54. The plurality of discharge holes 54 may be arranged spaced apart along a longitudinal direction of the oil flow path 52. The plurality of discharge holes 54 may be arranged spaced apart along the substantially vertical direction V. However, the present disclosure is not limited thereto, and the rotating shaft 50 may include a single discharge hole 54 depending on the embodiments.

The compressor 11 may include at least one cam 60. For example, the number of cams 60 may correspond to the number of rollers 200. For example, the number of cams 60 may correspond to the number of cylinders 100.

The cam 60 may be formed on the outer surface of the rotating shaft 50. The cam 60 may be arranged eccentrically with respect to the central axis of the rotating shaft 50. The cam 60 may be coupled to the inner surface of the roller 200. For example, most of the outer surface of the cam 60 may be in contact with most of the inner surface of the roller 200.

The cam 60 may be configured to rotate the roller 200 eccentrically. As the cam 60 is arranged eccentrically with respect to the central axis of the rotating shaft 50, the roller 200 coupled to the cam 60 may also be arranged eccentrically with respect to the central axis of the rotating shaft 50. Accordingly, the cam 60 and the roller 200 may rotate eccentrically with respect to the central axis of the rotating shaft 50, and the roller 200 may compress the refrigerant within the cylinder chamber 110 as the roller 200 rotates.

Meanwhile, although the cam 60 is described as a separate component from the rotating shaft 50, the cam 60 may be provided as a component of the rotating shaft 50. That is, the rotating shaft 50 may include the cam 60. In this case, it should be understood that the cam 60 is formed on the outer surface of the shaft body 51.

For example, the compressor 11 may include the upper cam 60*a* and the lower cam 60*b*. The upper cam 60*a* may be positioned above the lower cam 60*b*. The lower cam 60*b* may be positioned below the upper cam 60*a*.

The upper cam 60*a* may correspond to the upper roller 200*a*. The upper cam 60*a* may be coupled to the inner surface of the upper roller 200*a* to rotate the upper roller 200*a* eccentrically.

The lower cam 60*b* may correspond to the lower roller 200*b*. The lower cam 60*b* may be coupled to the inner surface of the lower roller 200*b* to rotate the lower roller 200*b* eccentrically.

According to one embodiment, the upper cam 60*a* and the lower cam 60*b* may be eccentric in opposite directions with respect to the central axis of the rotating shaft 50. In addition, the upper roller 200*a* and the lower roller 200*b* may be eccentric in opposite directions with respect to the central axis of the rotating shaft 50. Accordingly, a phase when the refrigerant in the upper cylinder chamber 110*a* is compressed by the upper roller 200*a* and a phase when the refrigerant in the lower cylinder chamber 110*b* is compressed by the lower roller 200*b* may be opposite to each other.

The compressor 11 may include at least one vane 300. For example, the number of vanes 300 may correspond to the number of rollers 200. For example, the number of vanes 300 may correspond to the number of cylinders 100.

The vane 300 may be arranged inside the cylinder 100. The vane 300 may be provided to partition the cylinder chamber 110. The vane 300 may partition the cylinder chamber 110 into the inlet chamber 111 into which the refrigerant is introduced and the compression chamber 112 into which the refrigerant is compressed. The vane 300 may be configured to be movable in conjunction with the rotation of the roller 200. One end of the vane 300 may be connected to the cylinder 100, and the other end of the vane 300 may be connected to the roller 200.

For example, the compressor 11 may include the upper vane 300*a* and the lower vane 300*b*. The upper vane 300*a* may be positioned above the lower vane 300*b*. The lower vane 300*b* may be positioned below the upper vane 300*a*.

The upper vane 300*a* may be arranged inside the upper cylinder 100*a*. The upper vane 300*a* may be provided to partition the upper cylinder chamber 110*a*. The upper vane 300*a* may be provided to partition the upper cylinder chamber 110*a* into the upper inlet chamber 111*a* and the upper compression chamber 112*a*. The upper vane 300*a* may be configured to be movable in conjunction with the rotation of the upper roller 200*a*. One end of the upper vane 300*a* may be connected to the upper cylinder 100*a*, and the other end of the upper vane 300*a* may be connected to the upper roller 200*a*.

The lower vane 300*b* may be arranged inside the lower cylinder 100*b*. The lower vane 300*b* may be provided to partition the lower cylinder chamber 110*b*. The lower vane 300*b* may be provided to partition the lower cylinder chamber 110*b* into the lower inlet chamber 111*b* and the lower compression chamber 112*b*. The lower vane 300*b* may be configured to be movable in conjunction with the rotation of the lower roller 200*b*. One end of the lower vane 300*b* may be connected to the lower cylinder 100*b*, and the other end of the lower vane 300*b* may be connected to the lower roller 200*b*.

The compressor 11 may include at least one cylinder cover 400. For example, the number of cylinder covers 400 may correspond to the number of cylinders 100.

The cylinder cover 400 may be provided to cover at least a portion of the cylinder chamber 110. The cylinder cover 400 may include a cover body 410, a connecting hole 411, and a support portion 420 that extends from the cover body 410 and is provided to support the shaft.

For example, the compressor 11 may include the upper cylinder cover 400*a* and the lower cylinder cover 400*b*. The upper cylinder cover 400*a* may be positioned above the lower cylinder cover 400*b*. The lower cylinder cover 400*b* may be positioned below the upper cylinder cover 400*a*.

The upper cylinder cover 400*a* may be disposed above the upper cylinder 100*a*. The upper cylinder cover 400*a* may be provided to cover an upper side of the upper cylinder chamber 110*a*. The upper cylinder cover 400*a* may include an upper cover body 410*a* and an upper support portion 420*a*. The upper cover body 410*a* may be coupled to the upper cylinder 100*a*. The upper support portion 420*a* may extend upward from the upper cover body 410*a*. The upper support portion 420*a* may be provided to support the rotating shaft 50. The upper support portion 420*a* may be provided to surround a portion of the outer surface of the rotating shaft 50. The upper support portion 420*a* may function as a bearing that rotatably supports the rotating shaft 50.

The upper cylinder cover 400*a* may include an upper connecting hole 411*a* connecting an inside of the upper cylinder chamber 110*a* and an inside of the upper muffler 500*a*. The refrigerant compressed in the upper cylinder chamber 110*a* may flow to the upper muffler 500*a* through the upper connecting hole 411*a*. For example, the upper connecting hole 411*a* may be formed by penetrating the upper cover body 410*a*.

The lower cylinder cover 400*b* may be disposed below the lower cylinder 100*b*. The lower cylinder cover 400*b* may be provided to cover a lower side of the lower cylinder chamber 110*b*. The lower cylinder cover 400*b* may include a lower cover body 410*b* and a lower support portion 420*b*. The lower cover body 410*b* may be coupled to the lower cylinder 100*b*. The lower support portion 420*b* may extend downward from the lower cover body 410*b*. The lower support portion 420*b* may be provided to support the rotating shaft 50. The lower support portion 420*b* may be provided to surround a portion of the outer surface of the rotating shaft 50. The lower support portion 420*b* may function as a bearing that rotatably supports the rotating shaft 50.

The lower cylinder cover 400*b* may include a lower connecting hole 411*b* connecting an inside of the lower cylinder chamber 110*b* and an inside of the lower muffler 500*b*. The refrigerant compressed in the lower cylinder chamber 110*b* may flow to the lower muffler 500*b* through the lower connecting hole 411*b*. For example, the lower connecting hole 411*b* may be formed by penetrating the lower cover body 410*b*.

The compressor 11 may include at least one valve 80. For example, the number of valves 80 may correspond to the number of cylinders 100.

The valve 80 may be provided on the cylinder cover 400 to allow or block the flow of the refrigerant. The valve 80 may allow the flow of the refrigerant based on a pressure of the refrigerant being greater than or equal to a predetermined level, and may block the flow of the refrigerant based on the pressure of the refrigerant being less than the predetermined level.

For example, the compressor 11 may include an upper valve 80*a* and a lower valve 80*b*. The upper valve 80*a* may be positioned above the lower valve 80*b*. The lower valve 80*b* may be positioned below the upper valve 80*a*.

The upper valve 80*a* may be configured to open and close the upper connecting hole 411*a* of the upper cylinder cover 400*a*. The upper valve 80*a* may open the upper connecting hole 411*a* based on the pressure of the refrigerant within the upper cylinder chamber 110*a* being greater than or equal to the predetermined level. The upper valve 80*a* may close the upper connecting hole 411*a* based on the pressure of the refrigerant within the upper cylinder chamber 110*a* being less than the predetermined level.

The lower valve 80*b* may be configured to open and close the lower connecting hole 411*b* of the lower cylinder cover 400*b*. The lower valve 80*b* may open the lower connecting hole 411*b* based on the pressure of the refrigerant within the lower cylinder chamber 110*b* being greater than or equal to the predetermined level. The lower valve 80*b* may close the lower connecting hole 411*b* based on the pressure of the refrigerant within the lower cylinder chamber 110*b* being less than the predetermined level.

The compressor 11 may include at least one muffler 500. For example, the number of mufflers 500 may correspond to the number of cylinders 100. For example, the number of mufflers 500 may correspond to the number of cylinder covers 400.

The muffler 500 may be configured to reduce noise generated when the compressed refrigerant flows. The muffler 500 may be configured to receive the refrigerant flowing out from the cylinder cover 400.

For example, the compressor 11 may include the upper muffler 500*a* and the lower muffler 500*b*. The upper muffler 500*a* may be positioned above the lower muffler 500*b*. The lower muffler 500*b* may be positioned below the upper muffler 500*a*.

The upper muffler 500*a* may be positioned above the upper cylinder chamber 110*a*. The upper muffler 500*a* may be positioned above the upper cylinder 100*a*. The upper muffler 500*a* may be positioned above the upper cylinder cover 400*a*. The upper muffler 500*a* may cover the upper cylinder cover 400*a*. The upper muffler 500*a* may be coupled to the upper cylinder cover 400*a* and/or the upper cylinder 100*a*.

The upper muffler 500*a* may reduce noise generated when the refrigerant compressed in the upper cylinder chamber 110*a* passes through the upper cylinder 400*a*. In general, when the high-pressure refrigerant is discharged through a narrow hole, etc., the noise may be excessively loud. While the upper muffler 500*a* covers the upper cylinder cover 400*a*, an upper muffler chamber may be formed between the upper muffler 500*a* and the upper cylinder cover 400*a*. The upper muffler chamber may be formed to have a relatively large width and volume compared to the upper cylinder chamber 110*a* and the upper connecting hole 411*a*. Accordingly, while the refrigerant compressed in the upper cylinder chamber 110*a* flows into the upper muffler chamber through the upper connecting hole 411*a*, a speed and pressure of the refrigerant may be reduced, thereby reducing the noise.

The upper muffler 500*a* may include a discharge portion 510 for discharging a refrigerant. The refrigerant in the upper muffler 500*a* may flow out of the compressing portion through the discharge portion 510. In addition, as will be described later, the refrigerant in the lower muffler 500*b* may also flow to the upper muffler 500*a* and then flow out of the compressing portion through the discharge portion 510.

The lower muffler 500*b* may be positioned below the lower cylinder chamber 110*b*. The lower muffler 500*b* may be positioned below the lower cylinder 100*b*. The lower muffler 500*b* may be positioned below the lower cylinder cover 400*b*. The lower muffler 500*b* may cover the lower cylinder cover 400*b*. The lower muffler 500*b* may be coupled to the lower cylinder cover 400*b* and/or the lower cylinder 100*b*.

The lower muffler 500*b* may reduce noise generated when the refrigerant compressed in the lower cylinder chamber 110*b* passes through the lower cylinder 400*b*. In general, noise may be excessively loud when the high-pressure refrigerant is discharged through a narrow hole, etc. While the lower muffler 500*b* covers the lower cylinder cover 400*b*, a lower muffler chamber may be formed between the lower muffler 500*b* and the lower cylinder cover 400*b*. The lower muffler chamber may be formed to have a relatively large width and volume compared to the lower cylinder chamber 110*b* and the lower connecting hole 411*b*. Accordingly, while the refrigerant compressed in the lower cylinder chamber 110*b* flows into the lower muffler chamber through the lower connecting hole 411*b*, a speed and pressure of the refrigerant may be reduced, thereby reducing the noise.

With reference to FIGS. 7 and 8, an example of the flow of the refrigerant will be described. In FIGS. 7 and 8, the flow of the refrigerant is indicated by dashed line arrows.

The refrigerant may be introduced into the upper cylinder 100*a*. The refrigerant may be introduced into the upper cylinder chamber 110*a* through the upper inlet 120*a* (refer to FIGS. 3, 4, and 5). As the upper roller 200*a* rotates in the upper cylinder chamber 110*a*, the refrigerant in the upper cylinder chamber 110*a* may be compressed. When the pressure of the compressed refrigerant is greater than or equal to the predetermined level, the upper valve 80*a* may open the upper connecting hole 411*a*. The compressed refrigerant may be introduced into the upper muffler 500*a* through the opened upper connecting hole 411*a*. The refrigerant introduced into the upper muffler 500*a* may be discharged through the discharge portion 510 (refer to FIGS. 3 and 5) of the upper muffler 500*a*.

The refrigerant may be introduced into the lower cylinder 100*b*. The refrigerant may be introduced into the lower cylinder chamber 110*b* through the lower inlet 120*a* (refer to FIGS. 3, 4, and 5). As the roller 200 rotates in the lower cylinder chamber 110*b*, the refrigerant inside the lower cylinder chamber 110*b* may be compressed. When the pressure of the compressed refrigerant is greater than or equal to the predetermined level, the lower valve 80*b* may open the lower connecting hole 411*b*. The compressed refrigerant may be introduced into the lower muffler 500*b* through the opened lower connecting hole 411*b*. The refrigerant inside the lower muffler 500*b* may flow into the upper muffler 500*a* along a connecting flow path 90. The connecting flow path 90 may connect the upper muffler chamber and the lower muffler chamber. For example, the connecting flow path 90 may be formed by overlapping a hole 402 formed in the lower cylinder cover 400*b*, a hole 102 formed in the lower cylinder 100*b*, a hole 71 formed in the mid-plate 70, a hole 101 formed in the upper cylinder 100*a*, and a hole 401 formed in the upper cylinder cover 400*a* (refer to FIG. 5). The refrigerant introduced into the upper muffler 500*a* through the connecting flow path 90 may be discharged through the discharge portion 510 (refer to FIGS. 3 and 5) of the upper muffler 500*a*.

Figure 9:
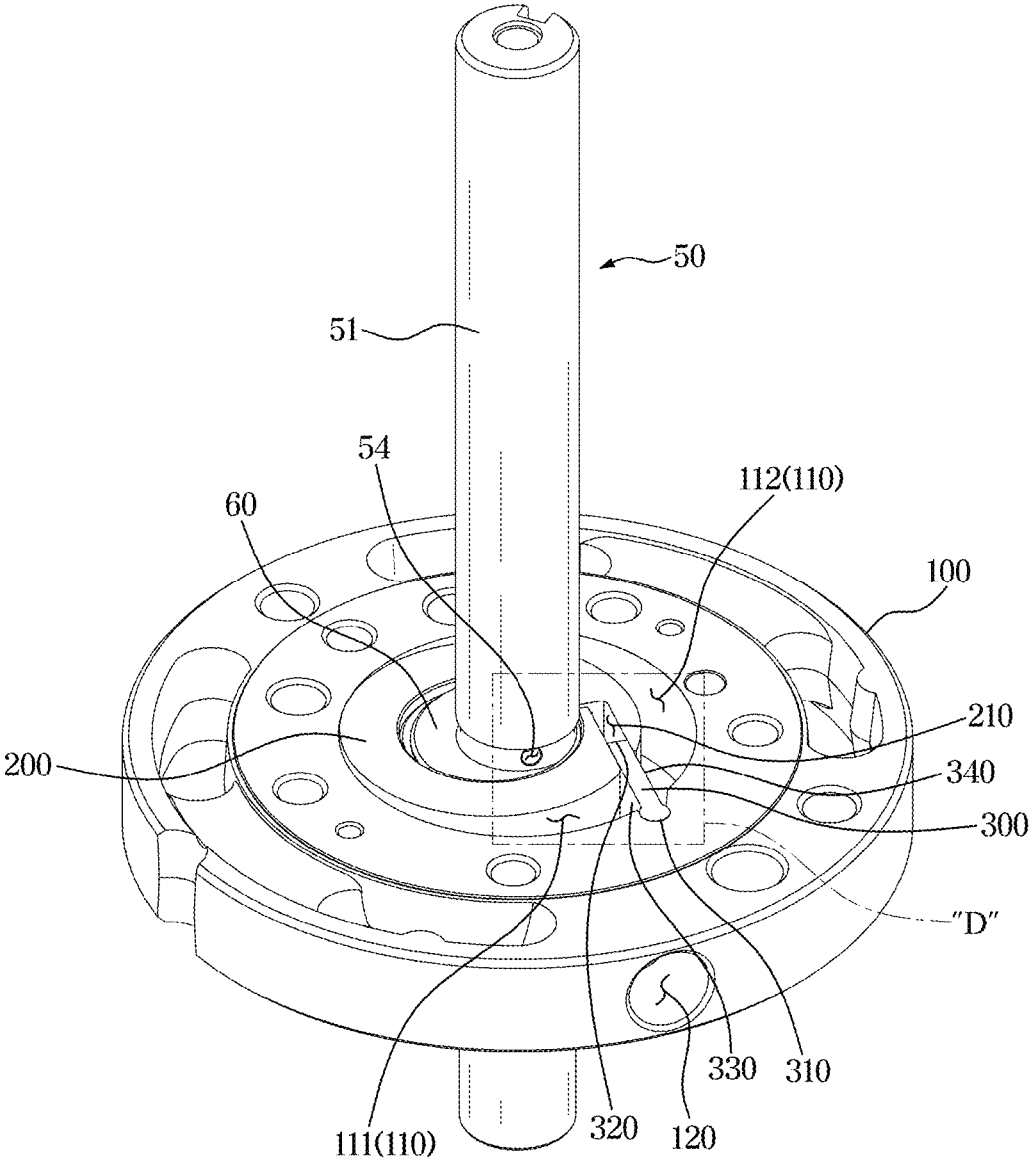
FIG. 9 illustrates a rotating shaft, a cam, a cylinder, a roller and a vane according to one embodiment of the present disclosure.
Figure 10:
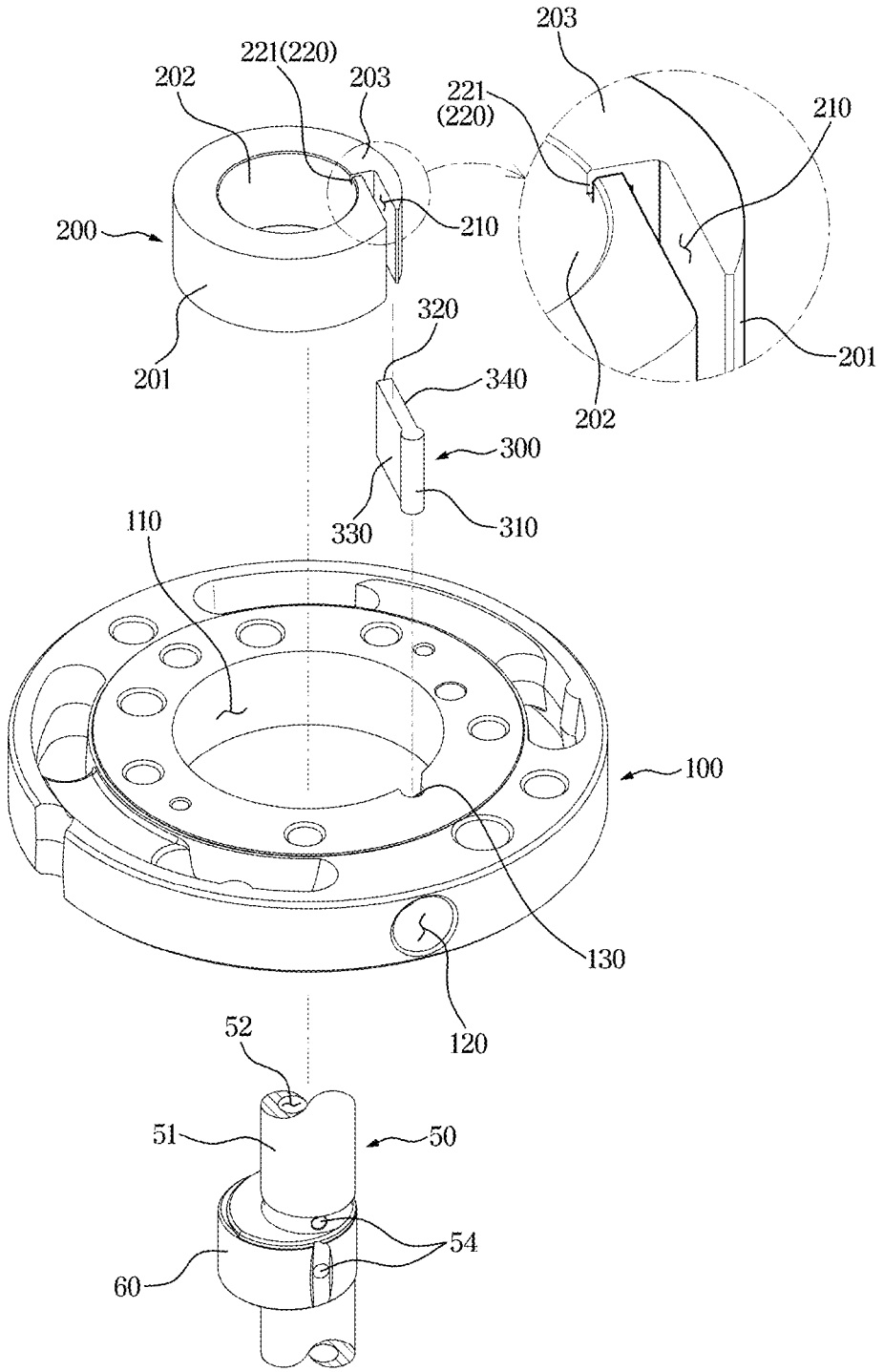
FIG. 10 is an exploded view of the rotating shaft, the cam, the cylinder, the roller and the vane according to one embodiment of the present disclosure.
Figure 11:
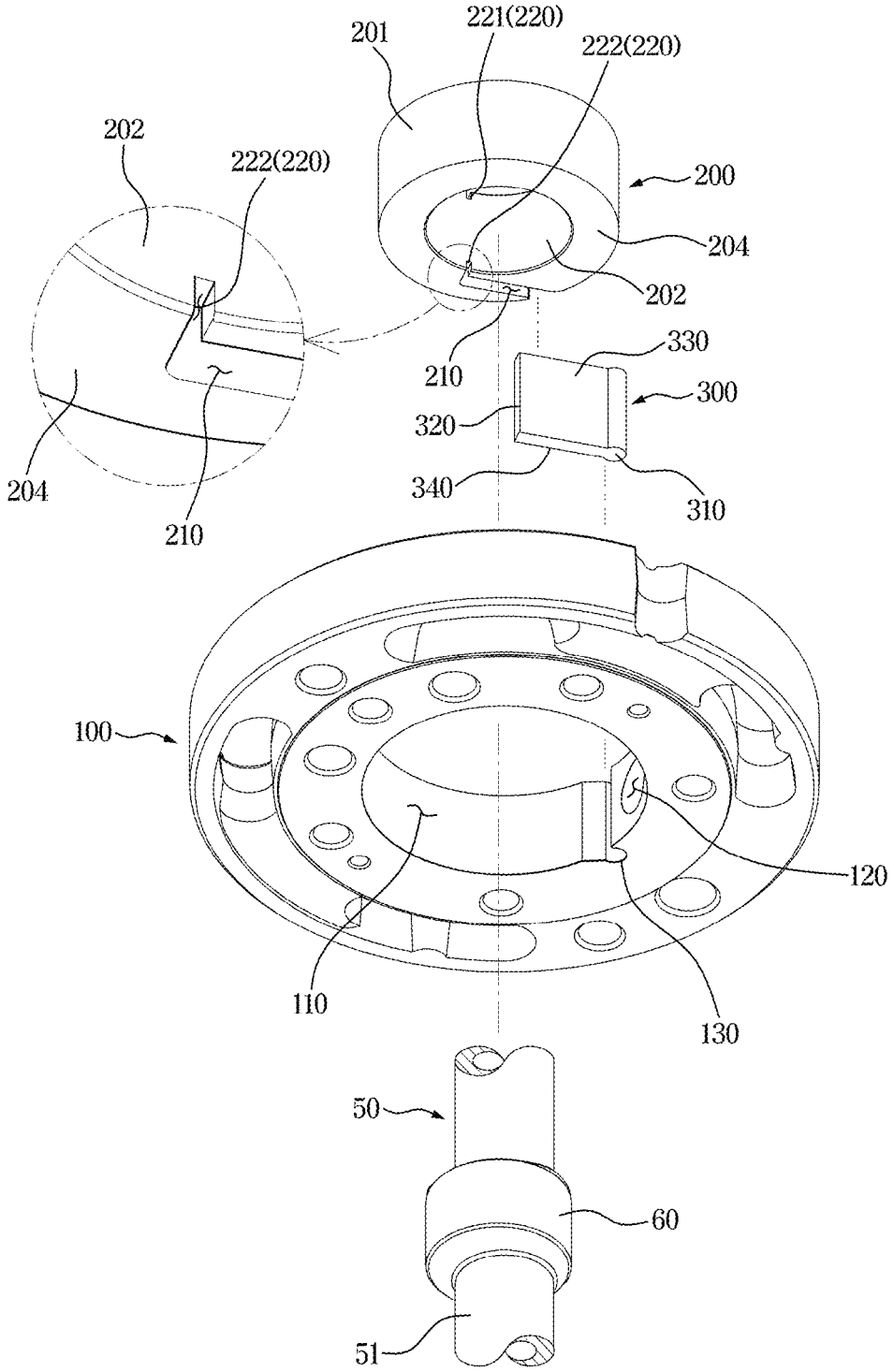
FIG. 11 illustrates the rotating shaft, the cam, the cylinder, the roller and the vane illustrated in FIG. 10 when viewed in a different direction from the direction illustrated in FIG. 10.

FIG. 9 illustrates a rotating shaft, a cam, a cylinder, a roller and a vane according to one embodiment of the present disclosure. FIG. 10 is an exploded view of the rotating shaft, the cam, the cylinder, the roller and the vane according to one embodiment of the present disclosure. FIG. 11 illustrates the rotating shaft, the cam, the cylinder, the roller and the vane illustrated in FIG. 10 when viewed in a different direction from the direction illustrated in FIG. 10.

Referring to FIGS. 9 to 11, the compressor 11 according to one embodiment of the present disclosure may include the rotating shaft 50, the cam 60, the cylinder 100, the roller 200, and the vane 300.

The cylinder 100 may include the cylinder chamber 110. The cylinder chamber 110 may be partitioned into the inlet chamber 111 and the compression chamber 112 by the vane 300. For example, the inlet chamber 111 may be defined by an outer surface 201 of the roller 200, the inner surface of the cylinder 100, and one side of the vane 300 (a first vane side 330 to be described later). For example, the compression chamber 112 may be defined by the outer surface 201 of the roller 200, the inner surface of the cylinder 100, and the other side of the vane 300 (a second vane side 340 to be described later).

The cylinder 100 may include the inlet 120 configured to communicate with the inlet chamber 111 of the cylinder chamber 110. A refrigerant may flow into the inlet chamber 111 through the inlet 120.

The cylinder 100 may include a fixing portion 130 provided to fix the vane 300. The fixing portion 130 may have a shape corresponding to a first end 310 of the vane 300. For example, the fixing portion 130 may be recessed radially outward from the inner surface of the cylinder 100.

The roller 200 may be configured to be rotatable in the cylinder chamber 100. The roller 200 may be configured to compress the refrigerant flowing into the cylinder chamber 100 as the roller 200 rotates. The roller 200 may receive rotational force from the rotating shaft 50. The roller 200 may be configured to rotate eccentrically by the cam 60.

The roller 200 may include the vane groove 210. The vane groove 210 may be provided to allow a portion of the vane 300 to be inserted thereinto. A portion of the vane 300 may be configured to be movable within the vane groove 210. A portion of the vane 300 may be configured to reciprocate within the vane groove 210. For example, a portion of the vane 300 may be configured to slide within the vane groove 210.

The vane groove 210 may be provided to open toward the cylinder chamber 110. The vane groove 210 may be formed on the outer surface 201 of the roller 200. The vane groove 210 may be provided to be recessed from the outer surface 201 of the roller 200. The vane groove 210 may be formed by being cut from the outer surface 201 of the roller 200. The vane groove 210 may be formed to penetrate an upper surface 203 and a lower surface 204 of the roller 200.

The vane groove 210 may be referred to as a vane slot 210. The vane groove 210 may be referred to as a slider groove 210.

The roller 200 may include the oil guide 220. The oil guide 220 may be provided to guide oil. The oil guide 220 may be provided to drain oil. The oil guide 220 may be provided to guide oil placed between the outer surface 201 and an inner surface 202 of the roller 200. The oil guide 220 may be provided to guide oil within the vane groove 210. The oil guide 220 may be provided to discharge oil within the vane groove 210. The oil guide 220 may be provided to drain oil within the vane groove 210. The oil guide 220 may move oil within the vane groove 210 to the outside of the roller 200.

The oil guide 220 may extend between the vane groove 210 and the inner surface 202 of the roller 200. The oil guide 220 may have a shape extending from the vane groove 210 to the inner surface 202 of the roller 220. The oil guide 220 may be open toward the inner side of the roller 220.

For example, the oil guide 220 may be recessed from the upper surface 203 or the lower surface 204 of the roller 200. As an example, the roller 200 may include a top oil guide 221 that is recessed from the upper surface 203 of the roller 200 and/or a bottom oil guide 222 that is spaced downward from the top oil guide 221 and recessed from the lower surface 204 of the roller 200 (refer to FIGS. 10 and 11). Although not illustrated in the drawings, the oil guide 220 may also be formed to penetrate between the upper surface 203 of the roller 200 and the lower surface 204 of the roller 200. However, the present disclosure is not limited to the above-described example. The oil guide 220 may have various shapes so as to allow oil to flow, and the number of oil guides 220 is also not limited.

The oil guide 220 may be referred to as an oil path. The oil guide 220 may be referred to as an oil passage. The oil guide 220 may be referred to as an oil gate. The oil guide 220 may be referred to as an oil channel.

The vane 300 may be provided to partition the cylinder chamber 110 into the inlet chamber 111 into which a refrigerant is introduced, and the compression chamber 112 into which the refrigerant is compressed. The vane 300 may be configured to be movable within the vane groove 210 in conjunction with the rotation of the roller 200. As the roller 200 rotates, the displacement of the vane 300 within the vane groove 210 may vary.

The vane 300 may include the first end 310 that is fixed to the cylinder 100. The first end 310 may be fixed to the inner surface of the cylinder 100. The first end 310 may be fixed to the fixing portion 130 of the cylinder 100.

The vane 300 may include a second end 320 provided on an opposite side of the first end 310. The second end 320 may be provided to be positioned within the vane groove 210. The second end 320 may be configured to be movable within the vane groove 210 by the rotation of the roller 200. The second end 320 may be configured to reciprocate within the vane groove 210 by the rotation of the roller 200.

The vane 300 may include the first vane side 330. The first vane side 330 may connect the first end 310 and the second end 320. The first vane side 330 may be provided to be exposed to the inlet chamber 111. The first vane side 330 may be arranged to face the inlet chamber 111.

The vane 300 may include the second vane side 340. The second vane side 340 may be provided on an opposite side of the first vane side 330 to connect the first end 310 and the second end 320. The second vane side 340 may be provided to be substantially parallel to the first vane side 330. The second vane side 340 may be provided to be exposed to the compression chamber 112. The second vane side 340 may be arranged to face the compression chamber 112.

The vane 300 may be referred to as a partition member 300. The vane 300 may be referred to as a moving block 300. The vane 300 may be referred to as a slider 300.

The rotating shaft 50 may be configured to provide the rotational force to the roller 200. The rotating shaft 50 may be provided to penetrate the roller 200. The rotating shaft 50 may be provided to penetrate the cylinder 100.

The cam 60 may be formed on the outer surface of the rotating shaft 50. The center of rotation of the cam 60 may not coincide with the center of the rotating shaft 50. A central axis of the cam 60 may be radially eccentric to one side from the central axis of the rotating shaft 50.

The cam 60 may be provided on the inner side of the roller 200. The cam 60 may be inserted into the roller 200. The cam 60 may be coupled to the inner surface 202 of the roller 200. The outer surface of the cam 60 and the inner surface 202 of the roller 200 may be provided to face each other.

The cam 60 may transmit the rotational power of the rotating shaft 50 to the roller 200. The cam 60 may be configured to rotate together with the rotating shaft 50 and the roller 200. The cam 60 may be configured to rotate the roller 200 eccentrically.

Figure 12:
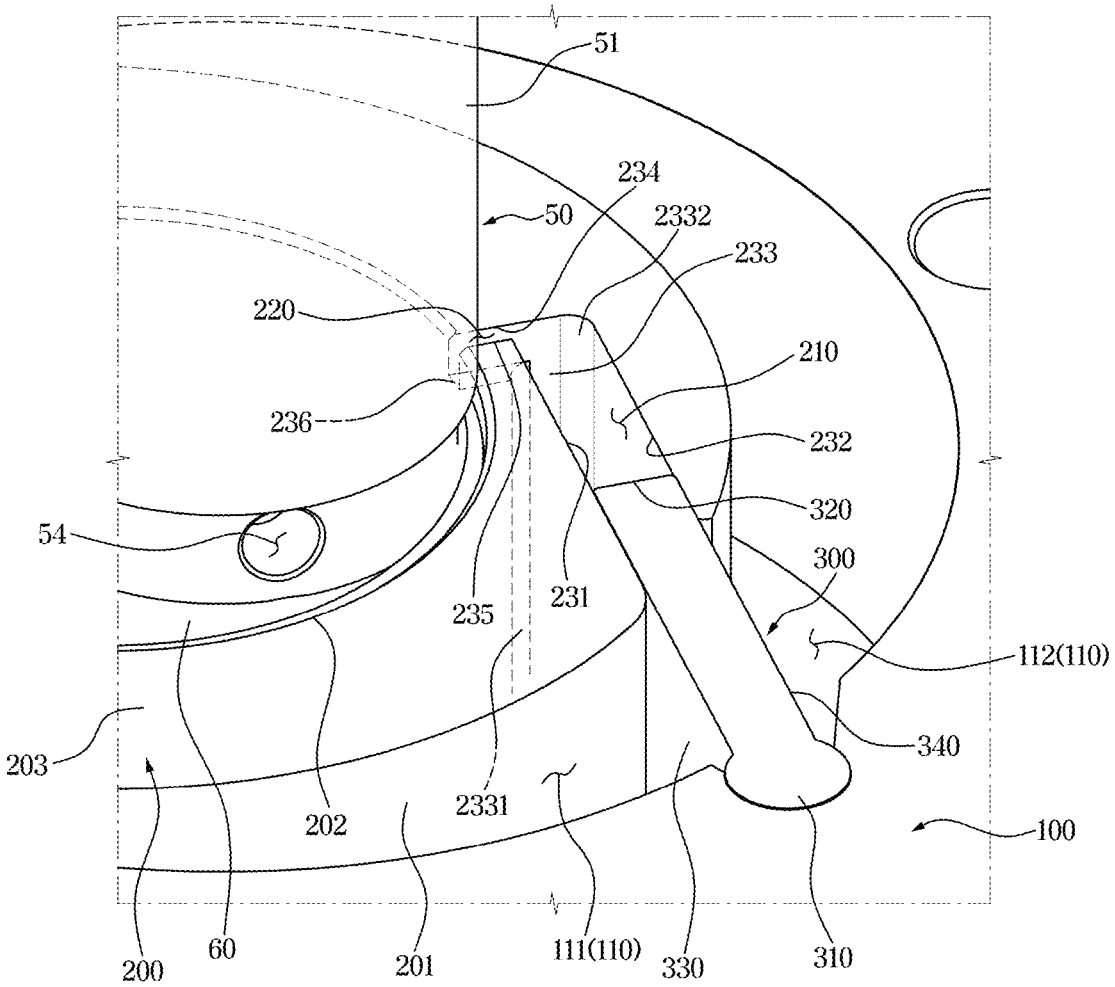
FIG. 12 is an enlarged view of a portion D illustrated in FIG. 9.
Figure 13:
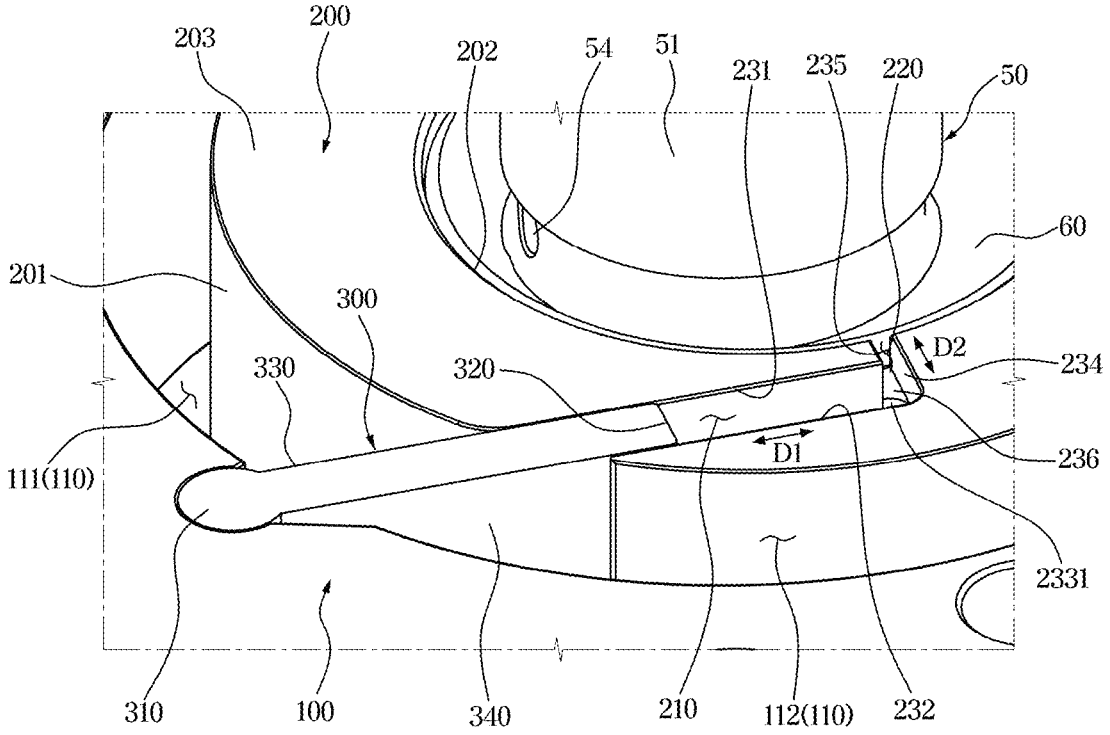
FIG. 13 illustrates the portion D illustrated in FIG. 9 when viewed in a different direction from the direction illustrated in FIG. 12.
Figure 14:
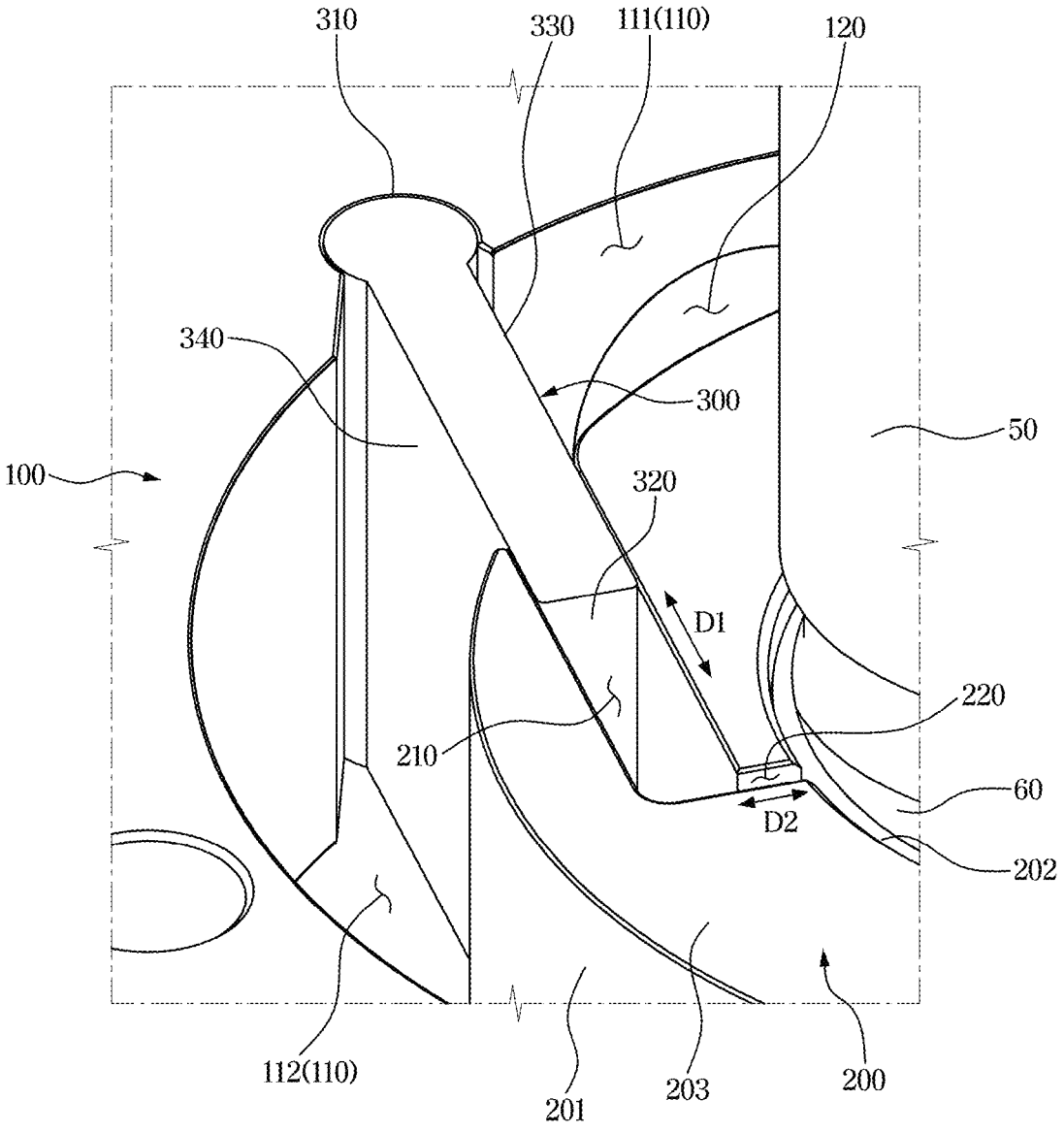
FIG. 14 illustrates the portion D illustrated in FIG. 9 when viewed in a different direction from the directions illustrated in FIGS. 12 and 13.
Figure 15:
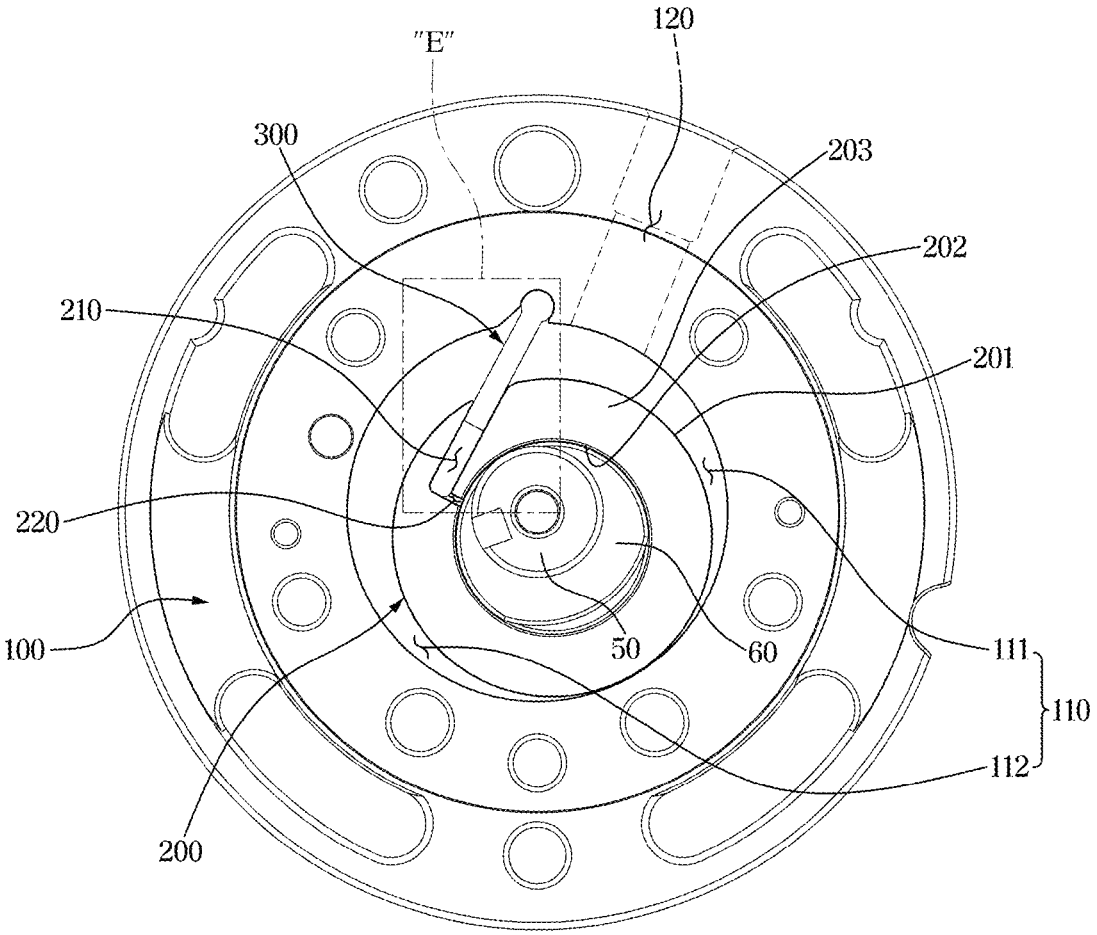
FIG. 15 is a plan view of the rotating shaft, the cam, the cylinder, the roller and the vane according to one embodiment of the present disclosure.
Figure 16:
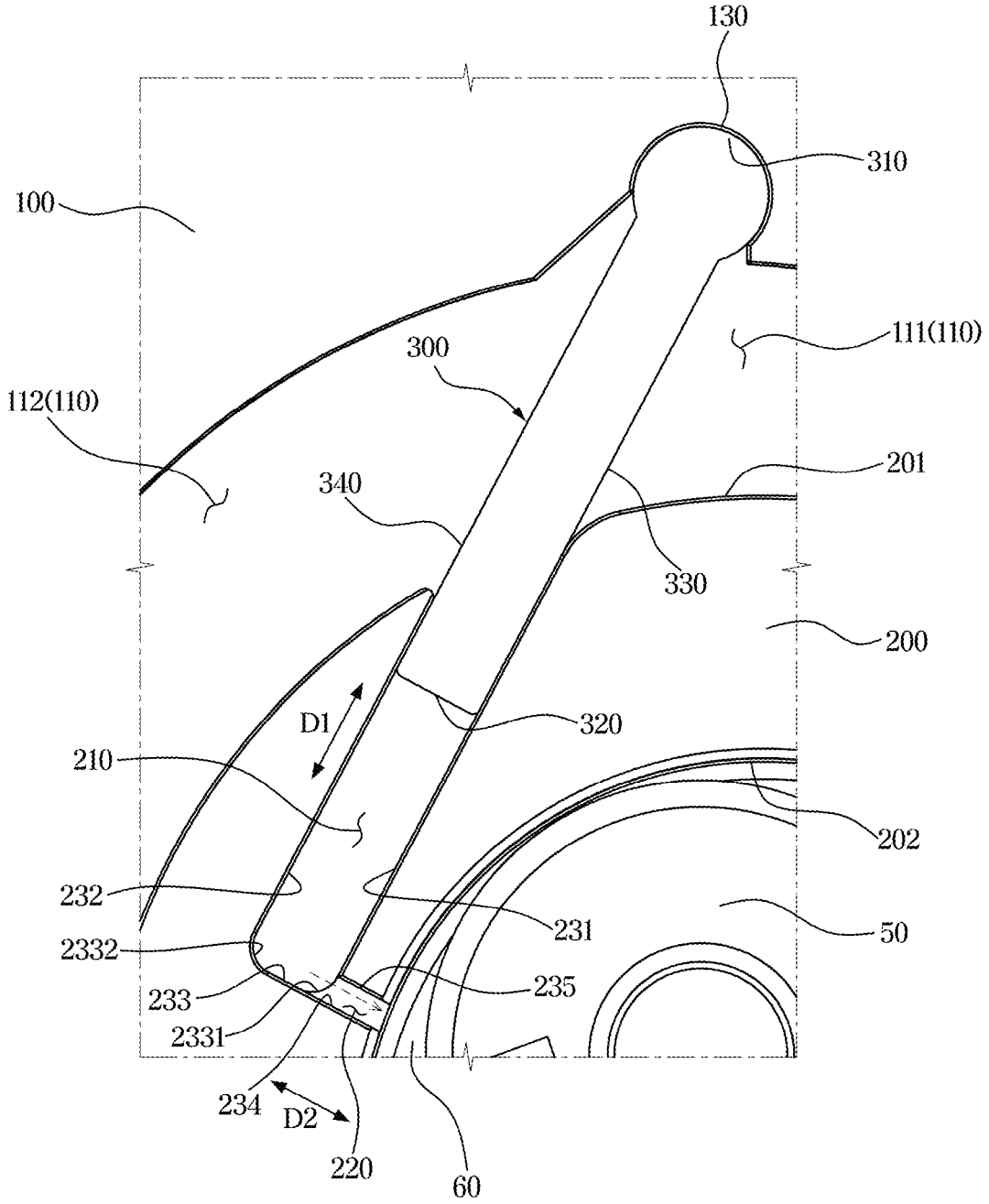
FIG. 16 is an enlarged view of a portion E illustrated in FIG. 15.

FIG. 12 is an enlarged view of a portion D illustrated in FIG. 9. FIG. 13 illustrates the portion D illustrated in FIG. 9 when viewed in a different direction from the direction illustrated in FIG. 12. FIG. 14 illustrates the portion D illustrated in FIG. 9 when viewed in a different direction from the directions illustrated in FIGS. 12 and 13. FIG. 15 is a plan view of the rotating shaft, the cam, the cylinder, the roller and the vane according to one embodiment of the present disclosure. FIG. 16 is an enlarged view of a portion E illustrated in FIG. 15.

The roller 200 may include the vane groove 210. The vane groove 210 may be formed on the outer surface 201 of the roller 200 to allow a portion of the vane 300 to be inserted and moved. Within the vane groove 210, a second end 232 of the vane 300, at least a portion of the first vane side 330 of the vane 300, and at least a portion of the second vane side 340 of the vane 300 may be arranged. For example, the vane groove 210 may extend substantially along a first direction D1. For example, the first direction D1 may be substantially the same as a moving direction of the vane 300. For example, the first direction D1 may be substantially the same as an extending direction of the first vane side 330 of the vane 300. For example, the first direction D1 may be substantially the same as an extending direction of the second vane side 340 of the vane 300. For example, the first direction D1 may be substantially a different direction from a radial direction of the roller 200. For example, the first direction D1 may include a direction inclined to the radial direction of the roller 200. For example, the first direction D1 may include a direction substantially intersecting the radial direction of the roller 200. However, the present disclosure is not limited to the examples described above, and the vane groove 210 may extend in various directions.

The roller 200 may include a first wall portion 231 provided to face the first vane side 330. The first wall portion 231 may be formed to penetrate the upper surface 203 of the roller 200 and the lower surface 204 of the roller 200.

The roller 200 may include a second wall portion 232 provided to face the second vane side 340. The second wall portion 232 may be spaced apart from the first wall portion 231. The second wall portion 232 may be arranged parallel to the first wall portion 231 with the vane 300 interposed therebetween. For example, the second wall portion 232 may be spaced apart from the first wall portion 231 in a second direction D2. The second wall portion 232 may be formed to penetrate the upper surface 203 of the roller 200 and the lower surface 204 of the roller 200.

The roller 200 may include a third wall portion 233 connecting the first wall portion 231 and the second wall portion 232. The third wall portion 233 may be provided to face the second end 320 of the vane 300. For example, the third wall portion 233 may include a first round portion 2331 connected to the first wall portion 231 and a second round portion 2332 connected to the second wall portion 232.

The vane groove 210 may be provided to be defined by the first wall portion 231, the second wall portion 232, and the third wall portion 233. The vane groove 210 may include a space surrounded by the first wall portion 231, the second wall portion 232, and the third wall portion 233.

The roller 200 may include the oil guide 220. The oil guide 220 may extend between the vane groove 210 and the inner surface 202 of the roller 200. The oil guide 220 may be in communication with the vane groove 210. The oil guide 220 may be open toward the inner side of the roller 200. The oil guide 220 may be open toward the rotating shaft 50. The oil guide 220 may be open toward the cam 60. For example, the oil guide 220 may be provided to communicate a gap g formed between the inner surface 202 of the roller 200 and the cam 60 (refer to FIG. 18). For example, the oil guide 220 may extend along the second direction D2.

The roller 200 may include a fourth wall portion 234. The fourth wall portion 234 may extend from the third wall portion 233. The fourth wall portion 234 may be provided to connect a portion of the third wall portion 233 and the inner surface 202 of the roller 200.

The roller 200 may include a fifth wall portion 235. The fifth wall portion 235 may be spaced apart from the fourth wall portion 234. For example, the fifth wall portion 235 may be spaced apart in the first direction D1. The fifth wall portion 235 may be arranged to be parallel to the fourth wall portion 234. The fifth wall portion 235 may extend from the first wall portion 231. The fifth wall portion 235 may be provided to connect a portion of the first wall portion 231 and the inner surface 202 of the roller 200.

The roller 200 may include a sixth wall portion 236. The sixth wall portion 236 may connect the fourth wall portion 234 and the fifth wall portion 235. For example, the sixth wall portion 236 may extend between the first round portion 2331 of the first wall portion 231 and the inner surface 202 of the roller 200.

The oil guide 220 may be provided to be defined by the fourth wall portion 234, the fifth wall portion 235, and the sixth wall portion 236. The oil guide 220 may include a space surrounded by the fourth wall portion 234, the fifth wall portion 235, and the sixth wall portion 236.

The vane groove 210 may extend along the first direction D1, and the oil guide 220 may extend along the second direction D2. The second direction D2 may be a different direction from the first direction D1. For example, the second direction D2 may be a direction intersecting the first direction D1. For example, the second direction D2 may be substantially the same as the radial direction of the roller 200. However, the present disclosure is not limited to the above-described example, and the vane groove 210 and the oil guide 220 may be provided in various shapes depending on the type of the compressor, the shape and/or arrangement of the vane, etc.

An example of the flow of the refrigerant is described with reference to FIG. 16. The flow of the refrigerant in FIG. 16 is indicated by a dashed arrow.

Oil in the vane groove 210 may be provided to flow along the oil guide 220. Oil in the vane groove 210 may be guided by the oil guide 220. As the vane 300 is inserted into the vane groove 210, oil in the vane groove 210 may move toward the oil guide 220. Oil pushed by the vane 300 in the vane groove 210 may flow toward the oil guide 210. Oil pressurized by the second end 320 of the vane 300 in the vane groove 210 may flow along the oil guide 210. Oil guided by the oil guide 220 may flow toward the rotating shaft 50. Oil guided by the oil guide 220 may flow toward the cam 60. That is, oil within the vane groove 210 may be discharged from the roller 200 by being guided by the oil guide 220. The oil guide 220 may be provided to discharge the oil within the vane groove 210.

In general, oil may be introduced between the components of the compressor to lubricate the components of the compressor. Oil may also be placed within the vane groove 210 of the roller 200. When the vane 300 is inserted into the vane groove 210 when it is assumed that the oil guide 220 is not provided, a pressure of the oil within the vane groove 210 may increase. This is because the oil is an incompressible material. Accordingly, a pressure of oil may apply excessive force to the vane 300, and thus the vane 300 may be damaged. For example, a wear amount of the first end 310 of the vane 300 may increase. In addition, when it is assumed that the oil guide 220 is not provided, the oil in the vane groove 210 may flow out into the cylinder chamber 110 by passing between the wall portion (e.g., the first wall portion 231 and the second wall portion 232) forming the vane groove 210 and the vane 300. When the oil in the vane groove 210 flows out into the inlet chamber 111, the refrigerant flowing into the inlet chamber 111 may be mixed with the oil in the vane groove 210. As the refrigerant in the inlet chamber 111 is mixed with the oil flowing out from the vane groove 210, a temperature and/or pressure of the refrigerant may increase. As the refrigerant mixed with the oil is compressed in the cylinder chamber 110, the volumetric efficiency of the compressor 11 may be reduced. In addition, when the refrigerant mixed with oil flows from the compressor 11 into the heat exchanger, the heat exchange performance of the heat exchanger may also deteriorate.

According to one embodiment of the present disclosure, the roller 200 may include the oil guide 220 provided to guide oil within the vane groove 210. The oil within the vane groove 210 may flow to the oil guide 220 by being pressurized by the vane 300. As a result, a pressure of the oil within the vane groove 210 may not increase. The vane 300 may not receive excessive force caused by the pressure of the oil. Damage to the vane 300 due to the oil pressure may be reduced and/or suppressed. In addition, as the oil within the vane groove 210 flows along the oil guide 220, the oil within the vane groove 210 may be restricted from flowing out toward the inlet chamber 111. The oil within the vane groove 210 may flow along the oil guide 220 as the oil is pressurized by the vane 300. The oil guided by the oil guide 220 may flow toward the rotating shaft 50 and/or the cam 60. As a result, the oil in the vane groove 210 may be prevented from flowing into the inlet chamber 111 as much as possible. The refrigerant in the inlet chamber 111 may be prevented from being mixed with the oil in the vane groove 210 as much as possible, and the decrease in volumetric efficiency of the compressor 11 may be prevented. As a result, according to the present disclosure, the life of the compressor 11 may be increased, and the efficiency of the compressor 11 may also not be reduced.

Figure 17:
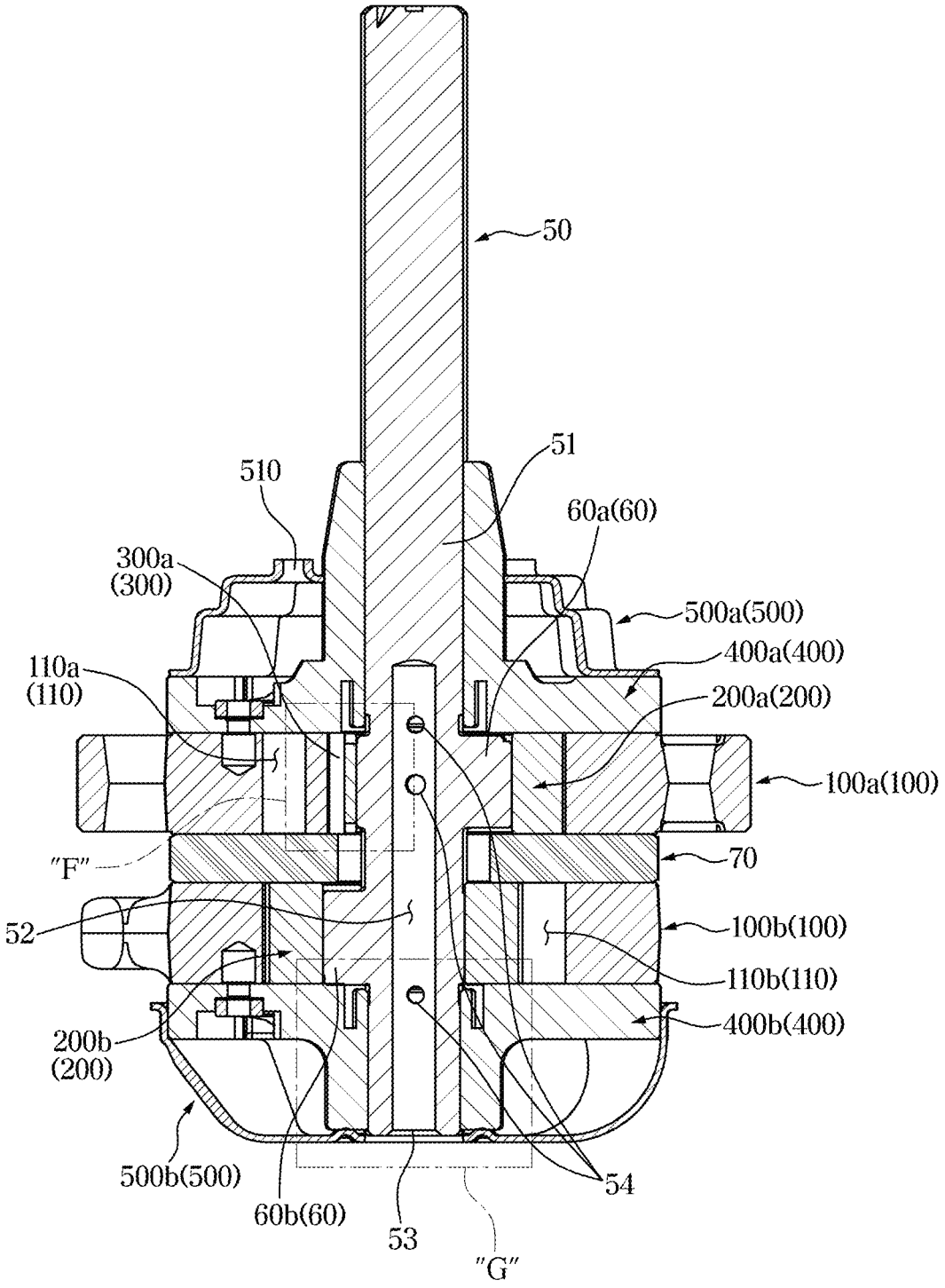
FIG. 17 is a cross-sectional view taken along line C-C' illustrated in FIG. 3.
Figure 18:
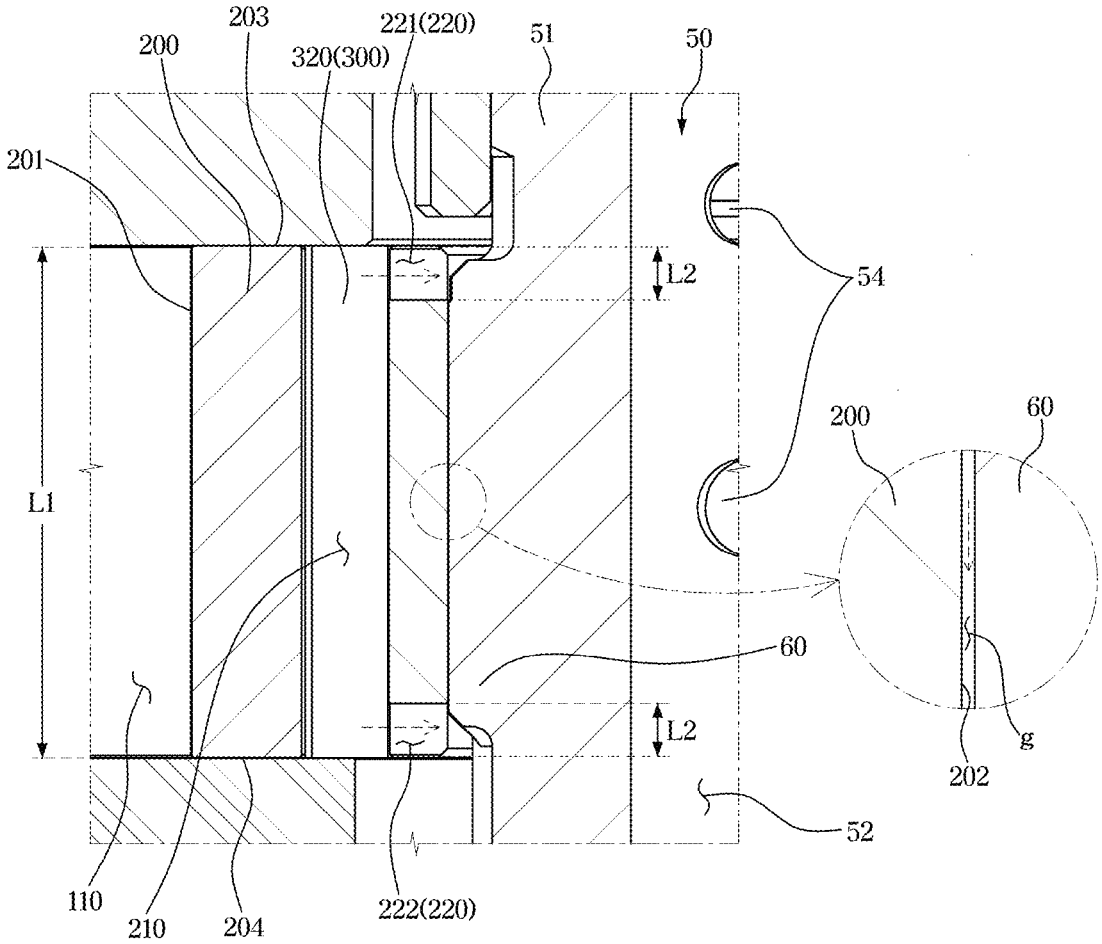
FIG. 18 is an enlarged view of a portion F illustrated in FIG. 17.
Figure 19:
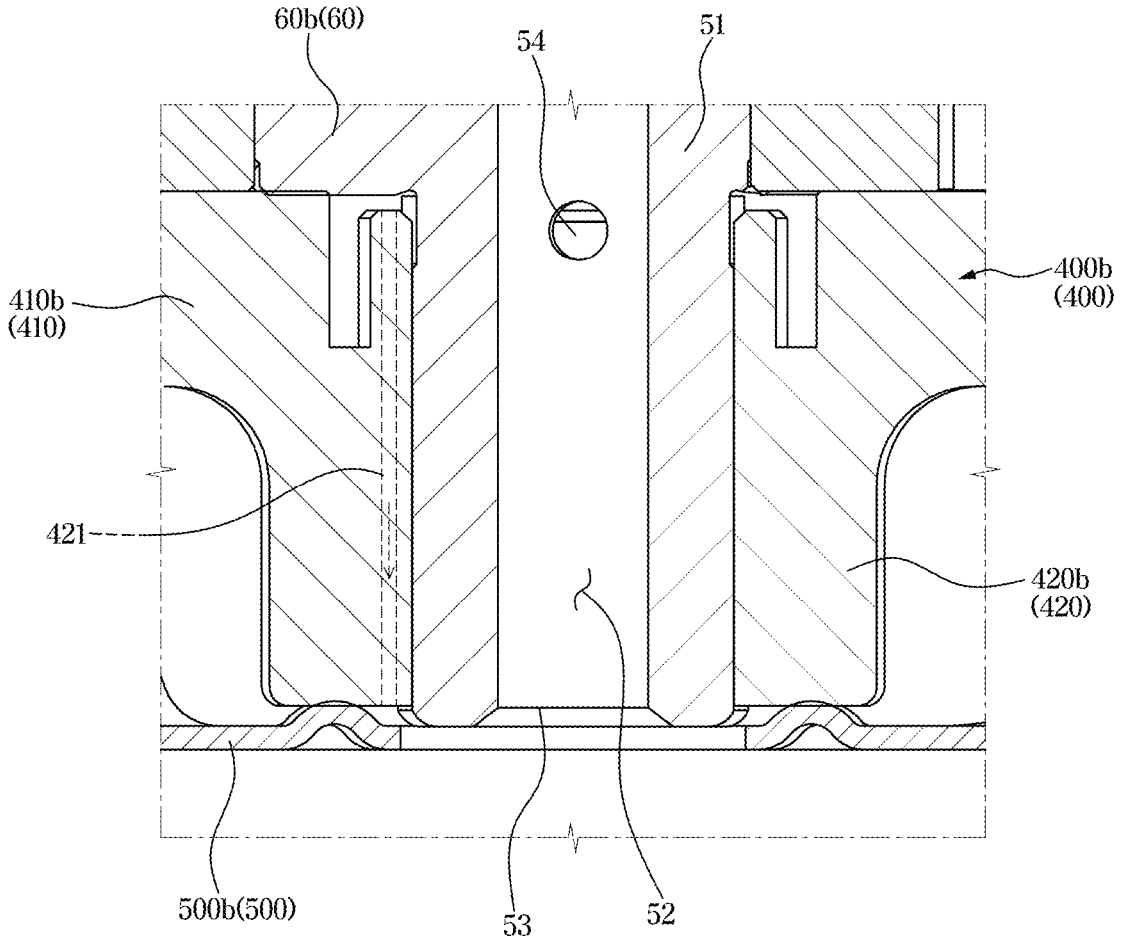
FIG. 19 is an enlarged view of a portion G illustrated in FIG. 17.

FIG. 17 is a cross-sectional view taken along line C-C' illustrated in FIG. 3. FIG. 18 is an enlarged view of a portion F illustrated in FIG. 17. FIG. 19 is an enlarged view of a portion G illustrated in FIG. 17.

FIG. 17 is a cross-sectional view taken along a surface forming the second end 320 of the vane 300. In FIGS. 18 and 19, the flow of the refrigerant is indicated by dashed arrows.

The roller 200 may include at least one oil guide 220. For example, the roller 200 may include the top oil guide 221 and/or the bottom oil guide 222. Each of the oil guides 220 may guide oil within the vane groove 210 to flow toward the rotating shaft 50. Each of the oil guides 220 may guide oil within the vane groove 210 to flow toward the cam 60. The oil within the vane groove 210 may flow out of the roller 200 through the oil guide 220.

Oil that is guided by the oil guide 220 and flows out from the roller 200 may be provided to lubricate the components of the compressor 11.

Referring to FIG. 18, oil passing through the oil guide 220 may flow between the roller 200 and the cam 60. The oil passing through the oil guide 220 may flow downward along the gap g formed between the inner surface 202 of the roller 200 and the outer surface of the cam 60. The oil may reduce friction between the roller 200 and the cam 60.

Referring to FIG. 19, the oil passing through the oil guide 220 may flow between the cylinder cover 400 and the rotating shaft 50. For example, the lower cylinder cover 400*b* may include the lower cover body 410*b* and the lower support portion 420*b* that extends from the lower cover body 410*b* and surrounds the rotating shaft 50. The lower cylinder cover 400*b* may include a cover groove 421 that is recessed into an inner surface of the lower support portion 420*b*. The cover groove 421 may be provided to guide oil passing through the oil guide 220. The cover groove 421 may be provided to guide oil flowing along the cover groove 421 downward. The cover groove 421 may allow oil to flow between the rotating shaft 50 and the support portion 420. The cover groove 421 may extend along the substantially vertical direction V. For example, the oil flowing along the cover groove 421 may pass through the lower muffler 500*b* and be accommodated in the housing 30 (refer to FIG. 2). The oil may reduce friction between the rotating shaft 50 and the cylinder cover 400.

However, the flow of the refrigerant illustrated in FIGS. 18 and 19 is merely exemplary, and the oil that is guided by the oil guide 220 and flows out from the roller 200 may be provided to lubricate various components of the compressor 11 in addition to the examples described above.

Meanwhile, referring to FIG. 18, the vane groove 210 may have a first length L1 along the vertical direction V, and the oil guide 220 may have a second length L2 less than the first length L1 along the vertical direction V. In the drawing, it is illustrated that the top oil guide 221 and the bottom oil guide 222 have the second length L2, but the length of the top oil guide 221 along the vertical direction V and the length of the bottom oil guide 222 along the vertical direction V may be different. In addition, in some cases, the length of the oil guide 220 along the vertical direction V may be substantially the same as the length of the vane groove 210 along the vertical direction V.

The compressor according to one embodiment of the present disclosure may include the housing 30; the cylinder 100 disposed inside the housing 30 and including the cylinder chamber 110 formed therein; the roller 200 configured to be rotatable in the cylinder chamber 110; and the vane 300 provided to partition the cylinder chamber 110 into the inlet chamber 111 into which a refrigerant is introduced and the compression chamber 112 into which the refrigerant is compressed. The roller 200 may include the vane groove 210 formed on the outer surface 201 of the roller 200 to allow a portion of the vane 300 to be inserted and moved; and the oil guide 220 extending between the vane groove 210 and the inner surface 202 of the roller 200 to guide oil within the vane groove 201.

The compressor may further include the rotating shaft 50 configured to provide rotational force to the roller 200 and provided to penetrate the roller 200. The oil guide 220 may open toward the rotating shaft 50.

The compressor may further include the cam 60 formed on the outer surface of the rotating shaft 50 and coupled to the inner surface 202 of the roller 200 to rotate the roller 200 eccentrically. The oil guide 60 may guide oil within the vane groove 210 to flow toward the cam 60.

The vane 300 may include the first end 310 fixed to the cylinder 100, and the second end 320 provided on the opposite side of the first end 310 and configured to be movable within the vane groove 210 by the rotation of the roller.

The oil guide 220 may be configured to allow oil, which is pressurized by the second end 320 of the vane 300 within the vane groove 210, to flow along the oil guide 220.

The oil guide 220 may be recessed from the upper surface 203 of the roller 200 or the lower surface 204 of the roller 200.

The oil guide 220 may be the top oil guide 221 recessed from the upper surface 203 of the roller 200. The roller 200 may further include the bottom oil guide 222 spaced downwardly from the top oil guide 221 and recessed from the lower surface 204 of the roller 200.

The vane groove 210 may extend along the first direction D1, and the oil guide 220 may extend along the second direction D2 intersecting the first direction.

The vane groove 210 may have the first length L1 along the vertical direction V, and the oil guide 220 may have the second length L2 less than the first length along the vertical direction V.

The vane 300 may include the first vane side 330 and the second vane side 340. The first vane side 330 may be provided to connect the first end 310 and the second end 320 and exposed to the inlet chamber 111. The second vane side 340 may be provided on the opposite side of the first vane side 330, provided to connect the first end 310 and the second end 320, and exposed to the compression chamber 112. The roller 200 may include the first wall portion 231 formed to penetrate the upper surface 203 and the lower surface 204 of the roller 200 and arranged to face the first vane side 330. The roller 200 may include the second wall portion 232 spaced apart from the first wall portion 231 and formed to penetrate the upper surface 203 and the lower surface 204 of the roller 200, and arranged to face the second vane side 340. The roller 200 may include the third wall portion 233 provided to connect the first wall portion 231 and the second wall portion 232 and arranged to face the second end 320 of the vane 300. The roller 200 may include the fourth wall portion 234 extending from the third wall portion 233. The roller 200 may include the fifth wall portion 235 spaced apart from the fourth wall portion 234 and extending from the first wall portion 231. The roller 200 may include the sixth wall portion 236 provided to connect the fourth wall portion 234 and the fifth wall portion 235.

The vane groove 210 may be provided to be defined by the first wall portion 231, the second wall portion 232, and the third wall portion 233. The oil guide 220 may be defined by the fourth wall portion 234, the fifth wall portion 235, and the sixth wall portion 236.

The compressor may further include the cylinder cover 400 arranged below the cylinder 100 and provided to cover the lower side of the cylinder chamber 110. The cylinder cover 400 may include: the support portion 420 provided to surround the rotating shaft 50; and the cover groove 421 recessed from the inner surface of the support portion 420. The cover groove 421 may be provided to guide oil passing through the oil guide 220.

The cover groove 421 may be configured to guide oil flowing along the cover groove 421 downward.

The housing 30 may be provided to accommodate oil. The rotating shaft 50 may include: the shaft body 51 forming the oil flow path 52; the suction hole 53 formed in the lower end of the shaft body 51 and provided to draw oil accommodated in the housing 30 into the oil flow path 52; and the discharge hole 54 provided to allow the oil flow path 52 of the shaft body 51 and the outer surface of the shaft body 51 to communicate with each other and provided to discharge oil flowing along the oil flow path 52.

The discharge hole 54 of the rotating shaft 50 may be provided in plurality. The plurality of discharge holes 54 may be spaced apart from each other along the longitudinal direction of the oil flow path 52.

The compressor according to one embodiment of the present disclosure may include the upper cylinder 100*a* including the upper cylinder chamber 110*a*; the upper roller 200*a* configured to be rotatable in the upper cylinder chamber 110*a* and configured to compress a refrigerant flowing into the upper cylinder chamber 110*a* as the upper roller rotates; the upper vane 300*a* provided to partition the upper cylinder chamber 110*a* and configured to be movable in conjunction with the rotation of the upper roller 200*a*; the lower cylinder 100*b* arranged below the upper cylinder 100*a* and including the lower cylinder chamber 110*b*; the lower roller 200*b* configured to be rotatable in the lower cylinder chamber 110*b* and configured to compress a refrigerant flowing into the lower cylinder chamber 110*b* as the lower roller rotates; the lower vane 300*b* provided to partition the lower cylinder chamber 110*b* and configured to be movable in conjunction with the rotation of the lower roller 200*b*; and the rotating shaft 50 configured to transmit rotational force to the upper roller 200*a* and the lower roller 200*b*. The upper roller 200*a* may include the upper vane slot 210*a* into which a portion of the upper vane 300*a* is insertable, and the upper oil guide 220*a* opened from the upper vane slot 210*a* toward the rotating shaft 50. The lower roller 200*b* may include the lower vane slot 210*b* into which a portion of the lower vane 300*b* is insertable, and the lower oil guide 220*b* opened from the lower vane slot 210*b* toward the rotating shaft 50.

The upper vane slot 210*a* may be formed to be recessed from the outer surface of the upper roller 200*a*. The upper oil guide 220*a* may extend from the upper vane slot 210*a* to the inner surface of the upper roller 200*a*. The lower vane slot 210*b* may be formed to be recessed from the outer surface of the lower roller 200*b*. The lower oil guide 220*b* may extend from the lower vane slot 210*b* to the inner surface of the lower roller 200*b*.

The compressor may further include the cylinder cover 400*b* arranged below the lower cylinder 100*b* and provided to cover the lower side of the lower cylinder chamber 110*b*. The cylinder cover 400*b* may include the lower support portion 420*b* provided to surround the rotating shaft 50; and the cover groove 421 recessed from the inner surface of the lower support portion 420*b* and provided to allow oil to flow between the rotating shaft 50 and the lower support portion 420*b*.

The compressor according to one embodiment of the present disclosure may include the housing 30; the cylinder 100 disposed inside the housing 30 and including the cylinder chamber 110; the roller 200 configured to be rotatable in the cylinder chamber 110, and configured to compress a refrigerant flowing into the cylinder chamber 110 as the roller rotates; the rotating shaft 50 configured to provide rotational force to the roller 200 and disposed to penetrate the roller 200; and the vane 300 including the first end 310 fixed to the cylinder 110 and the second end 320 configured to be movable by the rotation of the roller 200. The roller 200 may include the oil guide 220 provided to open toward the rotating shaft 50 so as to guide oil.

The roller 200 may further include the vane groove 210 formed to be recessed from the outer surface of the roller 200 to allow the second end 320 of the vane 300 to be inserted thereinto. The oil guide 220 may extend from the vane groove 210 to the rotating shaft 50. The oil guide 220 may be configured to guide oil pushed by the vane 300.

As is apparent from the above description, efficiency of a compressor may be improved.

Further, a life of a compressor may be increased.

Further, a compressor may include an oil guide provided to guide oil in a vane groove. The oil guide may prevent or reduce the oil in the vane groove from flowing into an inlet chamber. Accordingly, a volumetric efficiency of the compressor may be prevented from deteriorating. In addition, as the oil guide guides oil within the vane groove, a pressure of the oil within the vane groove may be lowered. As a result, a wear amount of the vane may be reduced.

Additional aspects of the disclosure will be set forth in part in the description which follows and, in part, will be obvious from the description, or may be learned by practice of the disclosure.

While the present disclosure has been particularly described with reference to exemplary embodiments, it should be understood by those of skilled in the art that various changes in form and details may be made without departing from the spirit and scope of the present disclosure.

The invention claimed is:

1. A compressor comprising:

a housing;

a cylinder inside the housing and including a cylinder chamber formed therein;

a roller configured to be rotatable in the cylinder chamber, the roller including a vane groove formed on an outer surface of the roller and an oil guide extending between the vane groove and an inner surface of the roller to guide oil within the vane groove; and a vane including:

a first end secured by a fixing portion of the cylinder, and a second end opposite to the first end, the second end extending into the vane groove and configured to, reciprocate inside the vane groove along a longitudinal axis of the vane during rotation of the roller, wherein the vane and the roller together are configured to partition the cylinder chamber into an inlet chamber into which a refrigerant is introduced and a compression chamber in which the refrigerant is compressed.

2. The compressor of claim 1, further comprising:

a rotating shaft configured to provide rotational force to the roller and to penetrate the roller, wherein the oil guide guides oil to flow between the vane groove and an opening of the oil guide on the inner surface of the roller toward the rotating shaft.

3. The compressor of claim 2, further comprising:

a cam formed on an outer surface of the rotating shaft and configured to rotate the roller eccentrically, wherein the oil guide guides oil to flow between the vane groove and the cam.

4. The compressor of claim 2, further comprising:

a cylinder cover arranged below the cylinder and provided to cover a lower side of the cylinder chamber, wherein the cylinder cover-includes a support portion provided to surround the rotating shaft, and a cover groove recessed from an inner surface of the support portion and provided to guide oil passing through the oil guide.

5. The compressor of claim 4, wherein the cover groove is configured to guide oil flowing along the cover groove downward.

6. The compressor of claim 2, wherein the housing is provided to accommodate oil, and the rotating shaft includes:

a shaft body forming an oil flow path, a suction hole formed in a lower end of the shaft body and configured to draw oil accommodated in the housing into the oil flow path, and a discharge hole configured to discharge oil flowing along the oil flow path to the outer surface of the shaft body.

7. The compressor of claim 6, wherein the discharge hole of the rotating shaft is provided in plurality, and the plurality of discharge holes is spaced apart from each other along a longitudinal direction of the oil flow path.

8. The compressor of claim 1, wherein the second end of the vane is configured to pivot about the first end during the rotation of the roller.

9. The compressor of claim 8, wherein the oil guide is configured to allow oil, which is pressurized by the second end of the vane within the vane groove, to flow along the oil guide.

10. The compressor of claim 1, wherein the oil guide is recessed from an upper surface of the roller or a lower surface of the roller.

11. The compressor of claim 1, wherein the oil guide is a top oil guide recessed from an upper surface of the roller, and the roller further includes a bottom oil guide below the top oil guide and recessed from a lower surface of the roller.

12. The compressor of claim 1, wherein the vane groove extends along a first direction, and the oil guide extends along a second direction intersecting the first direction.

13. The compressor of claim 1, wherein the vane groove has a first length along a vertical direction, and the oil guide has a second length less than the first length along the vertical direction.

14. The compressor of claim 1, wherein the vane includes:

a first vane side provided to connect the first end and the second end and exposed to the inlet chamber, and a second vane side provided on an opposite side of the first vane side, provided to connect the first end and the second end, and exposed to the compression chamber; and the roller includes:

a first wall portion formed to penetrate an upper surface and a lower surface of the roller and arranged to face the first vane side, a second wall portion spaced apart from the first wall portion and formed to penetrate the upper surface and the lower surface of the roller, and arranged to face the second vane side, a third wall portion provided to connect the first wall portion and the second wall portion and arranged to face the second end of the vane, a fourth wall portion extending from the third wall portion, a fifth wall portion spaced apart from the fourth wall portion and extending from the first wall portion, and a sixth wall portion provided to connect the fourth wall portion and the fifth wall portion.

15. The compressor of claim 14, wherein the vane groove is provided to be defined by the first wall portion, the second wall portion, and the third wall portion; and the oil guide is defined by the fourth wall portion, the fifth wall portion, and the sixth wall portion.

* * * * *